United States Patent [19]

Owen

[11] 4,256,932

[45] Mar. 17, 1981

[54] ROTARY SWITCH

[76] Inventor: Donald W. Owen, 334 Foreman Ave., Norman, Okla. 73069

[21] Appl. No.: 973,140

[22] Filed: Dec. 26, 1978

Related U.S. Application Data

[60] Division of Ser. No. 795,754, May 11, 1977, Pat. No. 4,160,224, which is a continuation-in-part of Ser. No. 646,185, Jan. 2, 1976, abandoned.

[51] Int. Cl.[3] ..... H01H 19/58

[52] U.S. Cl. ..... 200/11 TC; 200/14

[58] Field of Search ..... 336/150, 145, 146, 147, 336/180, 206, 223, 232; 323/43.5 R, 49; 200/11 TC, 14

[56] References Cited

U.S. PATENT DOCUMENTS

| | | | |
|---|---|---|---|
| 726,391 | 4/1903 | Armstrong et al. | 323/43.5 R |
| 3,484,727 | 12/1969 | Weber et al. | 336/147 |

*Primary Examiner*—Gene Z. Rubinson
*Assistant Examiner*—Morris Ginsburg
*Attorney, Agent, or Firm*—William R. Laney

[57] ABSTRACT

A device for transformation of alternating current-voltage which includes a core, a primary winding subassembly and a secondary winding subassembly. One or both of the primary and secondary winding subassemblies consists of at least one pair of equal turn and approximately equal resistance windings wrapped co-directionally around the core, and each having an equal number of tapped sections. A special tandem switch selectively interconnects tapped sections within winding pairs to provide a desired output terminal winding array such that all sections connected through the switch are energized, and are in the current carrying path at all selected switch positions, with selectively seriesed and selectively paralleled portions of the switch-coupled winding pairs being selectively encircuited at each switch position. The functioning primary and secondary windings are asymmetrically disposed in relation to each other at most of the switch positions, and the leakage reactance is unequal through the several paired windings when they are connected by said transformer switch to place less than all of the tapped sections of each in parallel.

27 Claims, 17 Drawing Figures

ROTARY SWITCH

RELATED APPLICATIONS

This applicatiion is a division of my United States Patent Application Ser. No. 795,754 entitled "TRANSFORMER" filed May 11, 1977, now U.S. Pat. No. 4,160,224, which application was, prior to election, a continuation-in-part of my earlier United States Patent Application Ser. No. 646,185 entitled "IMPROVEMENTS IN TRANSFORMER DEVICES" filed Jan. 2, 1976, now abandoned.

BACKGROUND OF THE INVENTION

1. Field of the Invention

This invention relates generally to alternating-current transformer devices, and more particularly, but not by way of limitation, to an improved adjustable transformer and switching device for relatively high voltage applications, such as providing varying voltage outputs for energization of oil field equipment and the like.

2. Description of the Prior Art

The prior art includes many types of adjustable transformers which include means for adjustment, not only in the secondary but in the primary, or in both windings. The prior art devices have used tapping or switching output structures for selecting the transformer turns ratio, and therefore, for obtaining a selected voltage transformation, but most of such transformer devices have done so by merely selecting a certain portion of the overall windings in accordance with desired output characteristics. Such devices, in relatively random selection of parts of the overall windings, have failed to optimize minimization and uniformity of core and winding losses in order to effect more efficient use of the volume of winding and core space, a consideration which becomes particularly important in high voltage energization applications as here contemplated relative to the present invention.

In U.S. Pat. No. 3,083,331 to M. A. Spurway, a transformer construction is proposed in which a multiple winding primary (or secondary) is utilized in the transformer with a selective switching arrangement in which the multiple windings thus provided can be seriesed or paralleled in the primary circuit to varying degrees to provide a selective output. In the Spurway transformer, the multiple windings of the primary are disposed symmetrically in relation to the secondary, and under all conditions of operation of the transformer, the leakage impedances of corresponding sections of the primary windings, as interconnected by the switch in respect to each other, are equal. The switching arrangement allows sections of the multiple windings to be selectively interconnected so that progressive variation is obtained from a wholly electrical series connection of the windings with each other, to a wholly electrical parallel connection.

While the Spurway series-parallel transformer winding arrangement provides good selective control of output voltage over a wide range of voltages, and reduces core and winding losses, its construction necessarily contemplates the placement of the several windings or sections of the primary around the core of the transformer by extending these windings or sections in opposite directions around the core in order to achieve the desired symmetry in respect to the secondary winding. This is necessary in order to maintain the leakage impedance through interconnected parts of the two primary windings or sections at an equal value.

SUMMARY OF THE PRESENT INVENTION

The present invention contemplates a high voltage, adjustable transformer device wherein the secondary and/or primary winding of the transformer is utilized in the form of pairs of separate equal turn windings, each subdivided down into an equal number of tapped sections such that individual sections of each winding pair within the secondary and/or primary is controlled through a multi-position tandem switch of unique construction for interconnection and interaction to thereby allow a wide variation of the transformation ratio with minimal variation in winding loss and greater power and capacity within a lesser volume of physical space, i.e., a smaller mass of core and conductor material. The transformer, as in the case of the Spurway transformer, makes cross connections between corresponding ends of each one of the multiple windings characteristic of either the secondary or primary of the transformer, so that the interconnected windings can be selectively and progressively varied from a wholly electrical series connection with each other to a wholly electrical parallel connection with each other.

The transformer of the present invention constitutes an improved construction in relation to the Spurway transformer in that the multiple windings used in either or both the primary and secondary are concurrently and co-directionally wound upon the core of the transformer and onto a common insulating paper which separates the turns of the winding, as well as the several windings, from each other. Although this construction prevents the transformer of the present invention from characteristically having equal leakage reactance across corresponding winding pair sections during all operational modes, as is attributable to the Spurway transformer, the operation of the transformer is not thereby significantly adversely affected. The winding loss and winding temperature rise resulting are only very slightly greater than they would be if the currents flowing through the parallel paths constituted by winding sections so connected through the tandem switch were exactly equal as a result of equal reactance in the parallel connected sections.

The ability to construct the transformer of the present invention by concurrently placing the multiple secondary or primary windings thereof on a common insulating paper sheet with co-directional wrapping or winding of the turns about the core, allows very significant labor savings over a construction of the type advocated by Spurway, and moreover, and importantly, increases short-circuit strength of the transformer over that characteristic of the Spurway device. This results from the winding of the conductors forming the multiple windings of the primary or secondary upon a common insulating material, as opposed to utilizing two separated insulation sheets wound in opposite directions at different times as required in the Spurway construction.

Broadly described, the transformer of this invention comprises a core, a primary winding wound about the core and a secondary winding wound about the core. Either the primary winding or the secondary winding, or both, are divided into one or more pairs of subwindings. The subwindings within each pair are characterized in having an equal number of turns, and an approximately equal resistance. The subwindings within each subwinding pair are physically separated from each other, and are wound co-directionally about the core upon a common physically integrated insulating material which physically interconnects the subwindings within each subwinding pair, and resists their separation from each other under short circuiting forces. The subwindings within each subwinding pair are characterized in having an equal number of tapped sections.

A special tandem switch interconnects the subwindings within each pair to each other so that, by the use of the tandem switch, the tapped sections within each subwinding in the pair can be selectively interconnected to place equivalent numbers of tapped sections in each of the paired subwindings in parallel, with the remainder of the sections in series, within the circuit which contains the paired subwindings. The special tandem switch thus functions to selectively interconnect tapped sections within subwindings of each pair of subwindings to provide a desired output terminal winding array such that all of the sections within each subwinding pair are energized, and are in the current carrying path at all of the optional switch positions. By reason of the co-directional winding of the subwindings within each subwinding pair about the core of the transformer, coupled with the manner in which the special tandem switch is used to selectively place certain tapped sections of such subwindings in parallel with each other, the paralleled sections of the subwindings are, at most of the selected switch positions, asymmetrically disposed in relation to the other winding or windings (primary or secondary) of the transformer employed to induce current flow in the subwindings, and the leakage reactance is therefore unequal through the several paired tapped sections of such subwindings.

In a preferred embodiment of the invention, the leads from the secondary subwinding pairs are extended to a special compound tandem switch assembly which comprises a pair of spaced tandem rotary switches mounted on a supporting structure in staggered or offset relation to each other to facilitate accessibility to each of the switches, and the ease with which the leads from the tapped subwindings of the transformer can be connected thereto. Each of the tandem rotary switches includes a common operator shaft and handle which functions to concurrently advance a pair of wiper elements between selected subwinding lead terminals connected to tapped sections of each of the subwinding pairs. The switch terminals to which the respective subwinding leads are connected are spatially oriented to minimize overlap and interference between incoming leads, and are physically spaced and supported by minimum structure of economical character.

An important object of the present invention is to provide a transformer which can be more easily and economically constructed due to the manner in which the windings of the transformer are placed about the core, which economical construction is accomplished with minimal increase in winding and core power losses, and in winding temperature increase during operation.

An additional object of the invention is to provide a transformer which is of high short-circuit strength.

A further object of the present invention is to provide a transformer having an improved switching structure for selectively controlling the input or output voltage at transformation ratios over a wide range.

Another object of the invention is to provide a transformer having increased power handling capability relative to its size and weight.

Yet another object of the invention is to provide a transformer of adjustable transformation ratio, in which transformer the flux in the core remains substantially constant, i.e., the core loss remains substantially constant.

A further object of the invention is to provide an adjustable transformer wherein all winding portions are used during all output and/or input tapped positions employed in adjusting the transformation ratio.

Yet another object of the invention is to provide an adjustable transformer device capable of providing a wide range of voltage variations at substantially constant voltage-ampere output as compared to previous types of transformer devices, and wherein the winding losses are minimized and are approximately equal for all adjusted voltages.

Another object is to provide an improved compound tandem switch assembly for use in a transformer which has multiple pairs of secondary or primary subwindings.

Additional objects and advantages of the invention will be evident from the following detailed description when read in conjunction with the accompanying drawings which illustrate the invention.

BRIEF DESCRIPTION OF THE DRAWINGS

FIG. 6 illustrates multiple views of paired subwindings interconnected in different switching positions, along with their respective calculated losses for the condition of equal turns per section of each winding. It is here assumed for purposes of the calculations that the turns of all are of equal resistance and that the current divides equally and that the winding is carrying the same volt-ampere rating at all positions.

DETAILED DESCRIPTION OF PREFERRED EMBODIMENTS OF THE INVENTION

Figure 1:
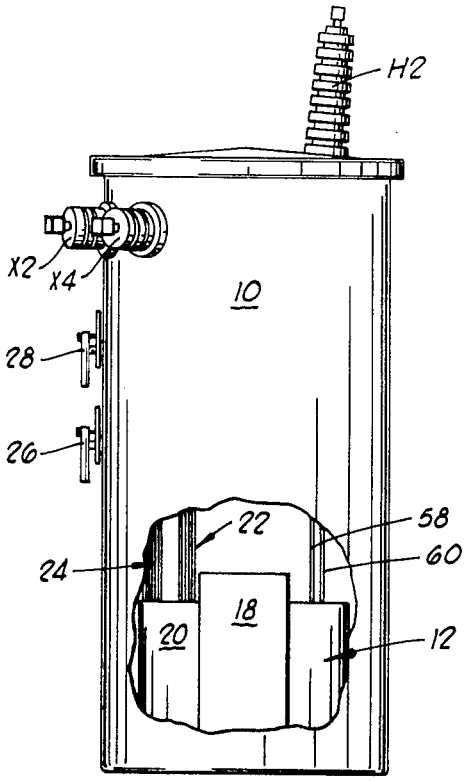
FIG. 1 is a side elevation view of a transformer constructed in accordance with the present invention and illustrating a portion of the transformer can or housing broken away to illustrate components positioned inside the housing.

Referring initially to FIG. 1 of the drawings, the transformer of the invention as there illustrated includes a generally cylindrical housing 10 in which the transformer core and winding, designated generally by reference numeral 12, are located. Pairs of insulated secondary terminals are provided on the outer side of the housing. In the illustrated and described embodiment of the invention, two pairs X1, X2, X3 and X4 of said secondary terminals are provided in correspondence to the two pairs of secondary subwindings to which reference will be hereinafter made. At the upper side of the transformer, a pair of primary insulated primary terminals $H_1$ and $H_2$ are provided.

The transformer structure located inside the housing 10 includes a soft iron core 18 of low-loss grain oriented silicon steel in a distributed gap construction. The windings of the transformer are wrapped about a leg of the core 18 extending centrally therethrough, and are enclosed within an insulating paper shell 20. A group 22 of electrically conductive leads extends from a pair of subwindings constituting one portion of the secondary of the transformer, and a second group 24 of electrically conductive leads extend upwardly from a point of connection to tapped sections within a second pair of subwindings constituting another portion of the secondary of the transformer. The leads 22 and 24 are connected at their upper ends to a pair of compound rotary tandem switches 26 and 28 which selectively interconnect various corresponding winding sections within the two pairs of subwindings of the secondary to provide adjustable transformation of voltage from the primary input to the secondary output. Appropriate switch structure for connecting input alternating current to the primary winding of the transformer is disposed on the outer side of the housing 10 at the opposite side thereof from that shown in FIG. 1.

Figure 2:
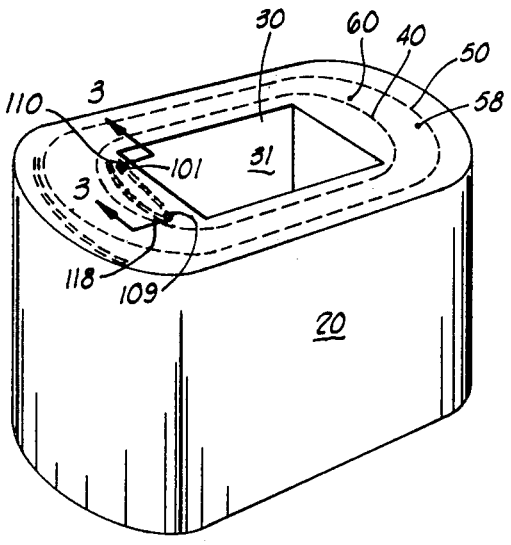
FIG. 2 is a schematic illustration of the transformer outside its housing, and illustrating, with the core removed, the manner in which the primary and secondary windings of the transformer are disposed in relation to each other.
Figure 3:
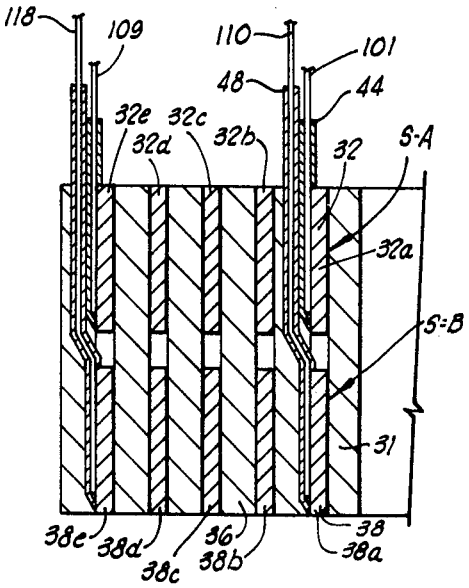
FIG. 3 is a sectional view taken along line 3—3 of FIG. 2.
Figure 4:
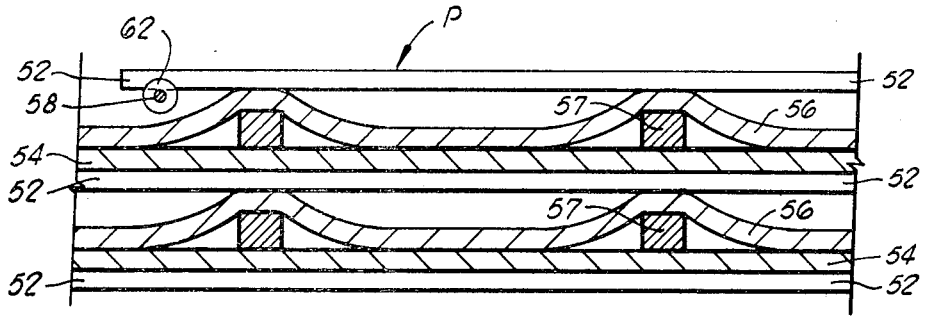
FIG. 4 is a sectional view through a portion of the primary winding used in the transformer.

FIGS. 2–4 of the drawings illustrate the manner in which the windings of the transformer are oriented and constructed. The core 18 has been removed from the windings to facilitate description of the winding construction. In FIG. 2, which is a somewhat schematic illustration, the central opening which receives one leg of the core is designated by reference numeral 30 and is surrounded by a suitable relatively stiff paper insulating material 31. A winding mandril is inserted in this opening for purposes of forming the windings therearound.

In laying on the windings of the transformer, there are initially concurrently wrapped about the core opening 30, in a plurality of generally concentric wraps, a pair of spaced secondary subwindings which will be hereinafter alluded to as S-A and S-B, and which are so designated in the drawings. Each of the subwindings S-A and S-B consists of a plurality of superimposed convolutions of a flat, elongated sheet or strip of thin aluminum metal. Such sheet as used in subwinding S-A is designated by reference numeral 32 in FIG. 3. The aluminum sheet 32 of the subwinding S-A as schematically illustrated includes concentric convolutions **32*a*, 32*b*, 32*c*, 32*d* and 32*e*. In actuality, in the construction of the transformer, a much greater number of concentric convolutions of the aluminum sheet 32 will be wrapped about the central core space 30** as the transformer is constructed.

Interpositioned between adjacent convolutions of the aluminum sheet 32 are a plurality of sheets 36 of strong paper having electrically insulating properties. Each sheet 36 of the insulating paper will be perceived to extend completely through the axial thickness of the windings of the transformer as measured in a direction parallel to the flat faces of the aluminum sheet conductors as they are wound in concentric convolutions. The interposed sheets 36 of insulating paper carry a thermal setting adhesive on opposite sides thereof so that a bond is established between the abutting surface areas of contact between the aluminum sheets in each convolution of the subwindings of the secondary, and the contiguous sheets of insulating paper. It should be pointed out that each convolution of the aluminum sheet 32 extending around the central core opneing 30 may be thought of as including one or several turns of the subwinding S-A for purposes of the discussion which follows.

In similar manner to the method of placement of the concentric coils or turns of the subwindings S-A about the winding mandril, convolutions or turns of the secondary subwinding S-B are also concentrically wound about the central core opening 30. The subwinding S-B is also made of an elongated sheet of electrically conductive aluminum metal, which sheet is designated by reference numeral 38. The several convolutions of the sheet conductor 38 are designated by reference numerals **38*a*, 38*b*, 38*c*, 38*d* and 38*e***. As in the case of the subwinding S-A of the secondary, the several convolutions of the subwinding S-B can be considered as one or more separate turns of this subwinding susceptible to tapping in selected increments of the total subwinding as hereinafter explained.

It will be noted in referring to FIG. 3 that the superimposed convolutions or turns of the subwindings S-A are axially spaced from the superimposed convolutions or turns of the subwinding S-B.

In the construction of the transformer, the subwindings S-A and S-B are wound about the core opening 30 occupied by a rotating winding mandril during winding of the coils of the transformer. Winding is commenced by initially placing one end of each of the aluminum conductor strips 32 and 38 opposite each other so that the winding of these conductor strips is commenced concurrently and at the same location in relation to the core opening 30. The winding then proceeds by rotation of the winding mandril with concurrent feeding of the elongated strips of sheet aluminum to the subwindings being formed. The sheets of aluminum conductor are fed superimposed upon a sheet of the paper insulating material 36 so that as each convolution is completed, the underlying pairs of transversely spaced convolutions in the subwindings S-A and S-B are covered by a sheet of insulating paper 36, and are thereby insulated from the next succeeding convolution or turn of the aluminum conductor. This procedure is continued until the two subwindings S-A and S-B are built up with the total number of turns therein which may be desired in the particular transformer under construction. The location of these two subwindings of the secondary is that which is shown in FIG. 2 as lying between the dashed line 40 and the central core opening 30.

As the sheet aluminum conductors 32 and 38 are wound about the central core opening 30 to build up the several turns within the subwindings S-A and S-B, the winding is intermittently arrested and electrical leads are extended from these conductors at certain points spaced along the length thereof. Thus, at the commencement of the winding of the sheet conductors 32 and 38, a electrically conductive lead 101 is secured to the flat face of the convolution or turn 32*a* of the conductor 32, and is encased within a flexible tube of electrically insulating material 44. In like fashion, an electrically conductive lead 110 is extended in a flexible tubular insulator 48 past the convolution 32*a* of the conductor 32, and is attached at one end to the convolution 38*a* of the sheet conductor 38. In similar fashion, a number of additional electrically conductive leads are connected to each of the sheet coductors 32 and 38 at spaced intervals therealong. Corresponding pairs of leads to the two sheet conductors are located at equally spaced intervals along the respective sheet conductors so as to define between spaced leads secured to each of the sheet conductors, equal numbers of turns within corresponding lead spacing intervals.

Figure 5:
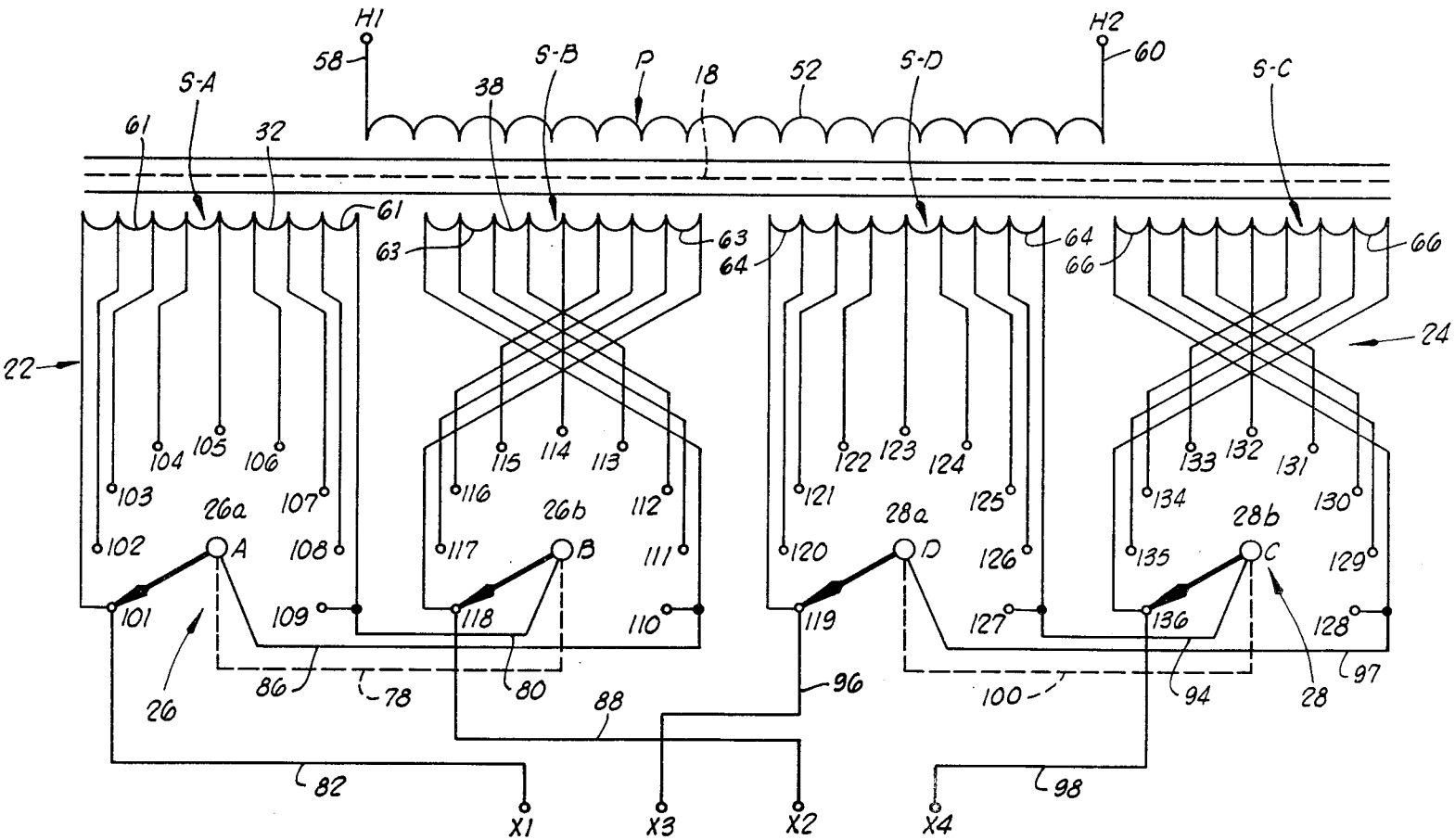
FIG. 5 is a schematic drawing of an adjustable transformer device constructed in accordance with the present invention.
Figure 8:
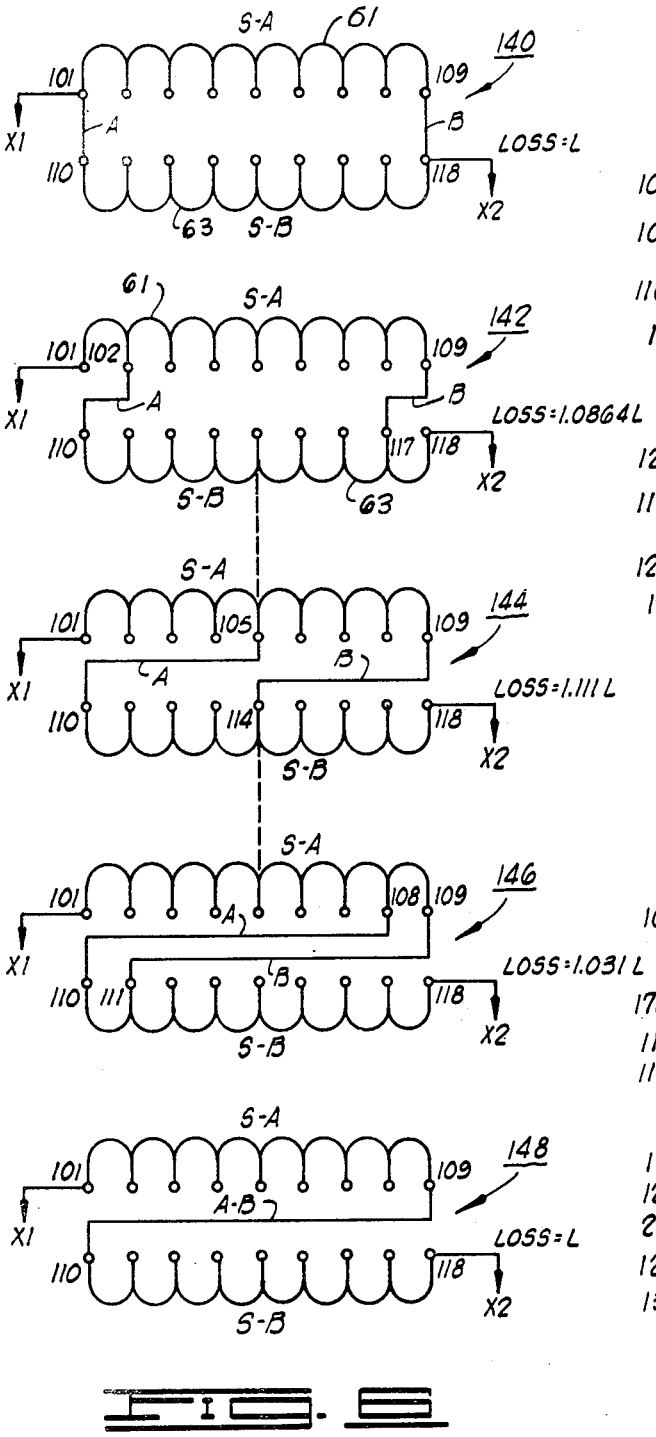
Figure 9:
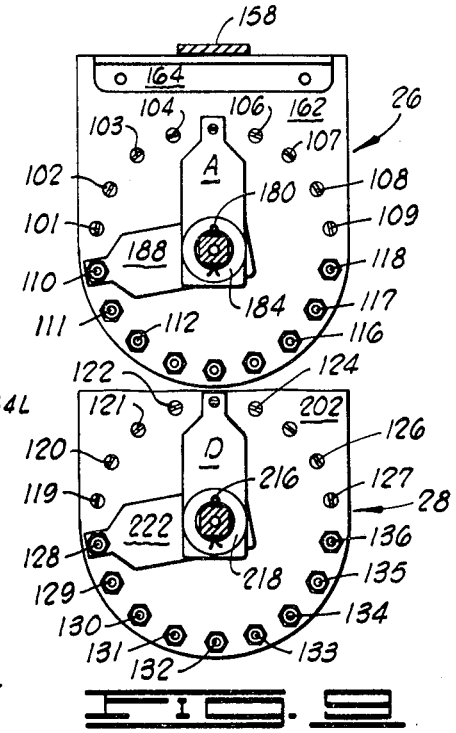
FIG. 9 is a sectional view taken along line 9—9 of FIG. 7.

For purposes of discussion, it will be assumed that nine of such leads are spaced along the length of each of the sheet conductors 32 and 38 so as to terminate at a final lead 109 projecting outwardly from the final convolution 32*e* of sheet conductor 32, and a final lead 118 projecting outwardly from the final convolution 38*e* of sheet conductor 38. Interpositioned at spaced intervals along the sheet conductors between the leads 109 and 118 located at the end of the final and outlying convolutions thereof, are the leads 102–108 attached to the sheet conductor 32, and the leads 111–117, attached to the sheet conductor 38. This arrangement is schematically illustrated in FIG. 5. It will be understood that each of the leads 101–118 is insulated by a flexible sleeve of insulating material of the type typified by the sleeves 44 and 48.

After the subwindings S-A and S-B of the transformer secondary have been wound around the central core opening 30, the winding of the primary P of the transformer is commenced. The primary P is constructed of suitable copper or aluminum wire and is wound around the subwindings S-A and S-B of the secondary in that space lying between the dashed lines 40 and 50 on the FIG. 2 schematic illustration of the transformer windings. It will thus be noted that the primary lies radially outwardly from the secondary subwindings S-A and S-B, and the coils of the primary are further displaced radially from the innermost convolutions or turns 32*a* and 38*a* of the sheet conductors 32 and 38 than from the outermost coils or turns 32*e* and 38*e* of these sheet conductors. It is important to keep in mind this asymmetrical relationship between these two generalized locations of parts of the subwindings S-A and S-B of the secondary in relation to the primary winding when the operation of the transformer is subsequently discussed herein.

The detailed construction of a portion of a suitable primary winding is illustrated in FIG. 4. A plurality of turns of the copper or aluminum conductor 52 are wound in superimposed concentric relation upon each other, and in side-by-side relation about the secondary subwindings. The copper or aluminum conductor 52 carries an insulating film material which allows the turns to be laid down in contiguous side-by-side relation as the primary is being wound. After one layer across the transverse dimension of the transformer has been laid down, this layer of the contiguous side-by-side turns of the primary is covered with a sheet 54 of paper material. Second sheets 56 of paper insulation material are then extended over suitable spacer blocks 57. The spacer blocks 57 are spaced at random intervals around the underlying primary winding layer, and between it and overlying layers of contiguous turns of the conductor 52. The spacer blocks are preferably constructed of a high density paper press board and are bonded by a suitable adhesive to the paper sheet 56. The spacer blocks function to space random contiguous layers of the primary winding from each other, and thus allow circulation of oil through the primary. At the beginning and end of the primary winding, a pair of electrical leads 58 and 60 are secured to the conductor (see FIG. 5) and are extended upwardly from the body of the windings similarly to the manner in which the leads 22 and 24 from the subwindings S-A and S-B from the secondary are extended upwardly within the housing 10. The lead 58 is surrounded by a tube or sheath of insulating material 62 as illustrated in FIG. 4.

On the radially outer side of the primary winding, and on the opposite side thereof from the subwindings S-A and S-B of the secondary, and additional pair of secondary subwindings S-C and S-D are located. These subwindings S-C and S-D are wound co-directionally around the primary by concurrent winding of a pair of elongated sheets or strips of aluminum conductors in exactly the same manner in which the subwindings S-A and S-B are wound. The subwindings S-C and S-D, of course, lie to the outside of the line 50 shown in FIG. 2. A plurality of electrical leads are attached to the aluminum sheet conductors making up subwindings S-C and S-D, with the method of attachment and the spatial arrangement of these leads being substantially identical to that which has been described as characteristic of the leads 101–118 which are attached to the sheet conductors 32 and 38 of the subwindings S-A and S-B. As will be better understood from the following discussion and a consideration of FIG. 5, the several leads which project upwardly from the subwinding S-C are, in consecutive sequence, from the start to the end of this subwinding as spaced therealong, denominated by reference numerals 128–136, and the leads attached at spaced intervals to the subwinding S-D are denominated by reference numerals 119–127.

In FIG. 5 of the drawings, the schematic illustration of the arrangement of the primary and secondary windings is illustrated, showing the leads from the several subwindings of the secondary and the manner in which these leads are connected to tandem switches for effecting adjustment of the voltage transformation ratio in a manner hereinafter described. The primary winding P is, as previously explained, connected at its opposite ends to leads 58 and 60 which terminate at appropriate input terminals $H_1$ and $H_2$. These terminals are, as previously stated, mounted on an outer side of the transformer housing 10. It should be understood that the primary winding P may be a tapped primary which includes an interchangeable series-parallel input scheme, or the primary may be constructed of several subwindings in a manner similar to the construction of the secondary winding network as hereinbefore alluded to, and subsequently discussed in detail.

It should further be understood that where the terms "wire" and "wiring" are used herein, these terms are used in the broad sense of including electrical conductors which can be either round or of other shaped cross-section, and such terms will also be employed to include the aluminum sheet conductors employed in the secondary subwindings.

The secondary network includes a first pair of subwindings S-A and S-B positioned at a location radially within the primary winding P of the transformer, and a second pair of subwindings S-C and S-D, positioned at a location which is radially outward of the primary winding. Each of the subwindings within each of the two pairs of subwindings is identical in winding composition, i.e., substantially equivalent wire parameters and equal numbers of turns are characteristic of each subwinding within a given pair. Moreover, in the illustrated embodiment of the invention, all of the wire parameters and numbers of turns in all four of the subwindings are equal to each other, although in other embodiments not illustrated, the number of turns within the subwindings in one pair might differ from the number of turns within the subwindings of another pair.

Each of the subwindings S-A, S-D is divided by tapping into a plurality of equal-turn winding sections 61, 63, 64 and 66, respectively. The leads 101–136 hereinbefore described as being connected to the several secondary subwindings S-A, S-D, thus constitute plural tapping or section leads, and these leads are illustrated in FIG. 5 as terminating at their ends opposite the ends connected to the aluminum sheet conductors used in the secondary subwindings in terminals positioned to be contacted by wiper elements of compound tandem selection switches hereinafter described in detail. It should be pointed out, for better comprehension of the following discussion, that, though four subwindings of the secondary have been illustrated, any number of pairs of such subwindings can be utilized so that subwindings up to an even number n can be included in the apparatus. In the illustrated embodiment, each of the subwindings includes an equal number of turns, and is therefore of equal rated voltage, but each of the respective ones of the subwindings S-A, S-D need not necessarily be equal to all others, since it is only required that equality apply to respective ones of first through n winding sections 61, 63, 64 and 66 as between each inductive winding. This flexibility of construction will be better understood as the invention is further explained subsequently herein.

The first novel compound tandem rotary switch 26 to which the leads 22 from the subwindings S-A and S-B are connected includes a first switching section **26*a*. Contacts or terminals at the ends of leads 101–109 coact with a switch wiper contact arm A. A second switching section 26*b* includes a wiper arm B which contacts terminals at the ends of leads 110–118. Wiper arms A and B are mechanically interconnected as shown by mechanical linkage 78, and undergo tandem movement so that rotational movement of the wiper arms will always maintain them in the same relative angular orientation. Thus, when wiper arm A is on the terminal of lead 104, wiper arm B will be on the terminal of lead 115**.

From the described arrangement and construction of the compound tandem rotary switch 26 and its interaction with the leads from the secondary subwindings S-A and S-B, it will thus be seen that the leads from the several equal turn sections of secondary subwinding S-A are contacted in consecutive sequence, running from the terminals 101 to 109, as the wiper arm A of switch section **26*a* is rotated. It will further be perceived that the terminal of lead 109 is connected via a suitable lead or conductor 80 to the wiper arm B of switch section 26*b*. The contact or terminal at the end of lead 101 is connected via lead or conductor 82 to the output terminal X1 hereinbefore described. In like manner, but opposite in orientation, respective successive ones of the leads from subwinding S-B are interconnected to the wiper arm B. Contact or terminal 110 is connected via a lead or conductor 86 to wiper arm A of switch section 26*a*, and contact 118 is connected by a conductor 88** to the output terminal X2.

In similar fashion, the equal turn sections of subwindings S-C and S-D are similarly connected through the leads 24 to a second compound tandem rotary switch 28 which includes tandem functioning wiper arms C and D. Thus, secondary subwinding S-D and each of the equal turn sections thereof are connected by the previously described leads 119–127 to contacts or terminals at the ends of these leads, with the contact at the end of lead 127 being connected by a lead or conductor 94 to wiper arm C, and the contact or terminal at the end of lead 119 being connected by lead or conductor 96 to output terminal X3. Switch section **28*b* is wired in the same manner as switch section 26*b*, and the wiper arm C successively contacts the terminals at the ends of leads 128–136, but in opposite rotational sequence to those connected to switch section 28*a*. The contact at the end of the terminus of lead 128 is connected by lead 97 to wiper arm D, while the final contact at the end of lead 136 is connected by lead or conductor 98 to output terminal X4. In the compound tandem rotary switch 28, the wiper arms C and D are similarly mechanically interconnected for rotational synchronization by a mechanical linkage 100**.

In operation, the transformer of the invention is particularly desirable for certain types of high voltage equipment energization, such as that required in downhole operations in oil field work. Many times, in the oil industry, there are different values of operating electrical loads required, and it is desired to have a transformer device, such as that of the present invention, which can be utilized to provide any of the various required voltages, and to enable rapid set-up and operation of equipment. Thus, primary taps need not be used to change secondary voltage, although primary tap variation still remains an option within the contemplation of the present invention to accommodate multiple primary voltages in some instances. No matter what output voltage is selected through interactive function of the compound tandem switches 26 and 28, the core flux of the transformer will remain substantially constant. That is, upon selection of the desired output voltages, which include selected shorting of output terminals X1–X4 as between series and parallel operations, and attendant selections by means of compound tandem switches 26 and 28, all winding sections within the several secondary subwindings S-A through S-D are utilized to enable more efficient utilization of subwinding space, conservation of core and packing materials, and a decrease in cooling requirements.

It is requisite that when the several output terminals from the secondary are connected in parallel (i.e., X1–X3 and X2–X4), all of the rotary wiper arms A, B, C and D of the switches 26 and 28 must be in the same angular position. When output connection of the several terminals X1–X4 is in series, the rotary tandem switches 26 and 28 may be offset or removed from each other, i.e., the position of wiper arms A and B may differ from the wiper arms C and D in terms of advance to the various sequenced terminals at the end of the respective leads of the respective secondary subwindings.

Adhering to these criteria, and assuming ideality in the transformer construction and the premise that the resistance of each turn within each subwinding section is equivalent to the resistance in every other turn within each subwinding section, the transformer losses will remain very nearly constant throughout the entire tap range. The core loss and primary winding loss will remain constant for a selected voltage and kilovolt ampere (kVA) rating, and the secondary losses will vary from a minimum at the extreme switch positions to a maximum at the fourth position of the tandem switch wipers, which maximum is only 12.4 percent higher than such minimum. This loss factor is based on a constant kVA output and eight equal winding section increments or switch steps, and assumes equal current division through parallel paths, as typified by the schematic illustration in FIGS. 5 and 6.

The manner in which the loss factor varies is illustrated in FIG. 6 of the drawings, which shows different switchable connections of secondary windings S-A and S-B by the respective tandem switch 26 associated therewith, and its wiper arms A and B. The calculated loss is illustrated for each case.

Before discussing FIG. 6, it should be pointed out that the purpose of illustrating the variation in the loss factor as illustrated in FIG. 6, and assuming ideality in the sense of equivalent resistance and equivalent leakage reactance in each parallel turn of each subwinding, is to show the manner in which transformers constructed in accordance with this invention, and including a plurality of selectively series-parallel interconnected subwinding sections, attains advantage with respect to conventional transformers in which the selective interconnection of sectors of paired subwindings partially in parallel and partially in series is not employed. It will be understood from the subsequent discussion herein that neither leakage reactance nor resistance is precisely equivalent in the case of each of the turns within each subwinding of the secondary of the transformer of this invention, and that therefore such ideal transformer analysis is not strictly applicable to the transformer of this invention. Nevertheless, the foregoing and the immediately following discussion dealing with FIG. 6 illustrate the advantages which characterize transformers of both the type herein presented and under discussion, and that type which is typified by the disclosure of Spurway U.S. Pat. No. 3,083,331. The comparative merits of the transformer of this invention vis-a-vis a transformer of the Spurway type are dealt with hereinafter.

Referring to FIG. 6, the diagram 140 illustrates the complete parallel switching connection as is shown in FIG. 5, i.e., wiper arm A of switch 26 is on the terminal or contact at the end of lead 101, and wiper arm B is connected to the contact or terminal at the end of lead 118. Thus, assuming the lead resistance negligible, each winding section within each subwinding S-A and S-B has a rated voltage E and a resistance R such that a rated current I can be equated in terms of power rating or volt-ampere rating (VA).

That is, for the situation of an assumed eight equal winding sections, $$I = \frac{VA}{8E} \tag{1}$$

Since parallel resistance will be equal to 8R/2, then $$\text{Loss } L = 4R\left(\frac{VA}{8E}\right)^2 = R\frac{(VA)^2}{16E} \tag{2}$$

$$\text{Loss } L = .0625R\left(\frac{VA}{E}\right)^2$$

The diagram 142 illustrates a situation wherein the wiper arms A and B are moved in a clockwise direction by one position to the contacts at the ends of leads 102 and 117 from the subwindings S-A and S-B, respectively. In this status, the rated voltage would be equal to 9E, with resistance equal to (7R/2)+2R or (11R/2), which in terms of loss equates $$L_1 = \frac{11R}{2}\left(\frac{VA}{9E}\right)^2 = .0679\left(\frac{VA}{E}\right)^2 \text{ or } 1.0864L \tag{3}$$

Similarly, for the midpoint switch position as shown in diagram 144, i.e., wiper arm A on the contact at the end of lead 105 and wiper arm B on the contact at the end of lead 114, the rated voltage will be 12E with a resistance of 2R+8R, or sum of 10R, and the loss equates as $$L_4 = 10R\left(\frac{VA}{12E}\right)^2 = .0694\left(\frac{VA}{E}\right)^2 \text{ or } 1.111L \tag{4}$$

The loss value may be similarly equated for each of the remaining diagrams 146 and 148 which illustrate rotation through the cycle of wiper arms A and B until the diagram 148 configuration wherein the subwindings S-A and S-B are completely in series. It can be noted that in the series configuration, the loss factor L is once again at its unity or lowest value. At no time during the switch rotation or successive series-paralleling arrangement will the loss have more than a 12.4 percent increase over the unity value L. It can be shown that for any tap arrangement, this number never increases above 12.5 percent. This is indeed a minimal factor, especially when considering that the loss in the secondary winding is generally less than 40 percent of the total loss of the transformer.

It will be apparent in referring to FIG. 6 that the current induced in the subwindings S-A and S-B of the secondary must, of course, flow in the same direction through the interconnected paralleled sections of the respective subwinding as the tandem switch 26 is switched to various positions to place equivalent sections of the subwinding of varying numbers of turns in parallel with each other. It is also true that current flowing in the secondary windings of the transformer must flow in contiguous windings in the same direction around the core, rather than in opposite directions, in order that the magnetic flux around each adjacent winding not be cancellative with respect to the magnetic flux in the other adjacent winding.

In any transformer in which the leakage impedance of the paired paralleled sections of switch interconnected subwindings is to be equal for all conditions of operation of the transformer, the paralleled subwinding sections must be symmetrically located in relation to the other winding of the transformer which functions to magnetically induce current flow in such paralleled subwindings. Stated differently, in a transformer, for example, in which sections within subwindings of a secondary are selectively placed in parallel, as in the present invention, if the desideratum of equal leakage impedance to current flow through these parallel sections is to be met for all conditions of operation of the transformer, the paralleled sections of the subwindings must be equidistant and spatially symmetric in their location and position with respect to the primary of the transformer. Otherwise, a different leakage reactance component of impedance will necessarily characterize the two subwindings.

When the described necessary attributes of current flow through the subwindings of the transformer are considered, it will be seen that the symmetry condition for equal leakage impedance cannot be met in a transformer construction in which the subwindings are wound side-by-side and co-directionally about a central core space. For example, when FIG. 6 is considered, it will be noted that in the switch position illustrated by diagram 142, the turns of the aluminum sheet conductor 32 which are between leads 102 and 109 are in parallel with the turns which are between leads 110 and 117 extending from the aluminum sheet conductor 38 forming the second subwinding S-B. It will further be noted that the first group of paralleled turns of the aluminum sheet conductor 32 of subwinding S-A are displaced to the right with respect to the location of the turns in that portion of the subwinding S-B which are connected in parallel therewith. This schematically illustrates that spatial displacement which actually exists within the transformer, as constructed, as a result of the turns of subwinding S-A which lie between leads 102 and 109 being located radially closer to the primary winding than are the turns of the subwinding S-B which are positioned between leads 110 and 117. When diagram 144 of FIG. 6 is considered, it wil be perceived that the displacement of the paralleled sections of the two subwindings S-A and S-B becomes even more pronounced. This is to say that it is necessary to proceed further along the aluminum sheet conductor 32 which makes up subwinding S-A toward the end thereof, and through a greater number of wraps around the central core opening, before the lead 105 is reached and the paralleled section is placed in the circuit, than is true of the portion of the subwinding S-B which is then in parallel as a result of the position of the switch at this time. The latter section lies relatively further in a radial direction from the encircling primary than does the section of the subwinding S-A which is paralleled, and which is between the leads 105 and 109. Symmetry thus cannot exist in this status of the transformer—that is, when the switching position is such that sections are paralleled in the manner shown in 144 of FIG. 6, and thus equal leakage impedance across the paralleled sections does not exist at this time. The same asymmetry and lack of equality of leakage impedance is true of all the switch positions attainable except that shown in diagrams 140 and 148 of FIG. 6 in which subwindings S-A and S-B are fully paralleled or fully seriesed.

In one type of transformer construction, a desideratum has been to provide equal leakage impedance across paralleled sections of subwindings in order to reduce the winding loss and winding temperature characteristics of the transformer. To attain such equal leakage impedance, it is necessary that subwindings employed be disposed symmetrically in relation to that winding of the transformer utilized to induce current flow in such subwindings, whether it be the primary or the secondary. Where the primary is the winding which is subdivided into a pair of subwindings, as typified by the transformer described in Spurway U.S. Pat. No. 3,083,331, this means that the two subwindings of the primary, as thus provided, must be disposed in a symmetric relationship to the secondary winding, and it further requires that the paralleled sections of the primary subwindings through which divided current flows during operation of the transformer must also at all times be symmetrically disposed in relation to the secondary.

This condition necessarily requires that the convolutions or wraps of the two subwindings of the primary must be turned in opposite directions about the central core opening of the transformer. Winding the convolutions of the conductors in the two subwindings in opposite directions requires either very complicated and expensive machinery and equipment for concurrently passing the conductors in opposite directions around the core, or winding of the two subwinding conductors at different times during the manufacture of the transformer. In either case, the cost and expense of manufacturing the transformer is relatively high.

Moreover, in a transformer constuction which seeks precisely equal leakage impedance through the paralleled sections of subwindings, as in the Spurway construction, the requirement to extend the several convolutions of the subwindings in opposite directions about the core makes it essential that insulating materials positioned between contiguous overlying convolutions be separately placed for each of the two different subwindings. In the transformer construction of this invention, as has previously been explained, the sheet of insulating paper employed can be placed beneath the axially spaced aluminum sheet conductors used in each of the two subwindings concurrently during the winding of the subwindings as a result of their co-directional winding. This greatly improves the short-circuit strength of the transformer since, in the event of short-circuiting of the transformer, the significant forces which are developed and tend to separate the subwindings from each other, thus damaging or destroying the transformer, are strongly opposed by the bonding strength afforded by the single or unitary sheets of paper extended between the spaced subwindings and bonded to each convolution of the two subwindings.

The advantages described with respect to the construction of the transformer of the present invention in terms of reduced cost or expense of construction and higher short-circuit strength in the finished transformer more than offset the slightly greater reduction in power loss which can be realized where the subwindings of the transformer are oppositely wound and placed in symmetrical relationship to the current-inducing winding. Thus, for example, comparative calculations for power loss resulting in the secondary subwindings of the transformer of the present invention, as compared to a similar transformer constructed in accordance with the Spurway patent, were developed. The calculations were developed for a status in which two subwindings of the secondary in each type of transformer were interconnected so that the number of parallel sections in the S-A subwinding and the S-B subwinding of the present transformer were compared to an equivalent number of paralleled sections in a Spurway-type (counterwound) transformer.

Equal output terminal current conditions in the two transformers were assumed, and the necessary condition that current flow divide equally between the paralleled sections of the secondary subwinding in the Spurway-type transformer was used in the calculations. It can be demonstrated that counterwinding equivalent conductors of each subwinding not only will result in equal leakage reactance of parallel sections, but will also result in equal resistance of parallel sections. This fact was used in the calculations. It can further be shown that the impedance characteristics of a section of a subwinding is independent of its direction of rotation about the core. Thus, sections of subwindings which occupy corresponding radial locations will have identical impedance values, regardless of whether the coil is co-directionally wound about the core, as in the present invention, or is counterwound about the core in a transformer of the sort disclosed in the Spurway patent.

For the purpose of calculating the relative power loss in a pair of secondary subwindings, a 50 kVA transformer of the present invention was tested to determine the impedance characteristics (both resistance and leakage reactance) of each individual section of each subwinding, using standard testing methods employed in the art.

In the test unit of the present invention, the impedance characteristics of parallel sections varied from the condition of equal resistance and equal leakage reactance when the subwindings were fully parallel (that is, all of the sections in one subwinding were in parallel with all of the sections in the second subwinding) to the condition of approximately 10% difference in resistance and 46% difference in leakage reactance when only one section of each subwinding was placed in parallel with a single section of the other subwinding.

Using the measurements obtained by the standard testing technique being used, the secondary winding power loss was then calculated for several different series-parallel-series connection arrays of both the co-directionally wound (present invention) secondary pair, and of the counterwound secondary pair. A list of power loss calculations based on the impedance measurements obtained is set forth in the following Table.

| Connection of Sections | | | | Calculated Power Loss, Watts | |
|---|---|---|---|---|---|
| Series | Parallel | Series | Illustration in FIG. 6 | Present Invention | Counterwound Transformer |
| 1 | 7 | 1 | 142 | 160.1 | 157.9 |
| 2 | 6 | 2 | not shown | 164.9 | 162.0 |
| 3 | 5 | 3 | not shown | 165.6 | 162.5 |
| 4 | 4 | 4 | 144 | 163.7 | 160.9 |
| 6 | 2 | 6 | not shown | 156.3 | 154.8 |
| 7 | 1 | 7 | 146 | 151.9 | 151.1 |

From the tabulated power loss values, it will be seen that a maximum of only 3.1 watts higher power loss results in the paired secondary subwindings of the transformer of the present invention than is the case in similarly interconnected series and parallel sections of the subwindings in a counterwound transformer. This maximum power loss occurs when five of the sections in each subwinding are placed in parallel with each other, leaving three sections of each subwinding connected in series with the paralleled sections. This slightly greater secondary winding power loss is negligible compared to total power losses inherent in transformer operation which, in transformers of the general type under discussion, will total around 800 watts. Moreover, the slightly higher power loss which is characteristic of the transformer of the present invention as compared to a paired counterwound subwinding transformer is more than offset by the greater economy of construction, and the greater short-circuit strength which characterizes the transformer of this invention.

FIGS. 7–10 illustrate one embodiment of the dual tandem rotary switches 26 and 28 used in the transformer of the invention. The switches 26 and 28 are mounted upon a F-shaped supporting frame 154 which includes a web portion 156 having a top leg 158 projecting normal to one end thereof, and a relatively shorter intermediate leg 160 projecting normal to the central portion thereof.

The switch 26 includes a terminal plate 162 secured to the outer end of the top leg 158 by means of an angle bracket 164. The terminal plate 162 is made of a suitable material of electrically insulating properties. A plurality of lead contacts or terminals are secured at spaced circumferential intervals in circular array around the terminal plate 162. Each of the terminals, in the illustrated embodiment, is in the form of a threaded bolt extended through the contact plate 162, and having a nut threaded upon the shank of the bolt on the opposite side of the terminal plate from the head of the bolt. It will be noted that terminals 101–109 which project through the upper half of the plate in a semicircular array project through the terminal plate with the shanks outwardly and facing away from the web portion 156 of the frame 156, whereas the terminals 110–118 positioned in the bottom portion of the terminal plate 162 are positioned with the threaded shank portions thereof facing toward the web portion 156 of the frame 154.

Figure 10:
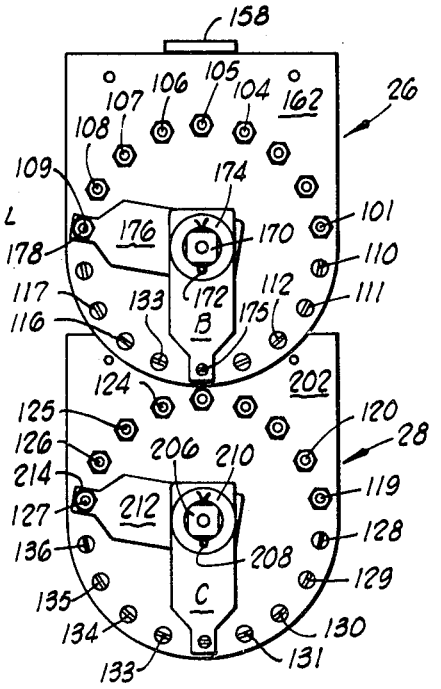
FIG. 10 is a rear elevation view of the switch illustrated in FIGS. 7–9.

A switch shaft 170 of electrically non-conductive material is extended through suitable journals or bearings in both the web portion 156 of the frame 154 and the center of the terminal plate 162. The outer end of the shaft 170 is retained in its position extended through the terminal plate by means of a cotter key 172 extended through the shaft and bearing against a washer 174 as shown in FIG. 10. The washer 174 in turn bears flatly against the rotary wiper arm plate B. The rotary wiper arm plate B is constructed of copper or other suitable electrically conductive material, and is keyed to the shaft 170 for rotation with the shaft. It will be noted that the outer end of the wiper arm plate B is provided with an aperture 175 and is positioned to selectively contact the rounded head of one of the bolts which form the terminals 110–117 circumferentially spaced in semicircular array around the terminal plate 162 as hereinbefore described. The rotary wiper plate B flatly bears against a fixed common terminal plate 176 which does not rotate with the shaft 170, and extends outwardly and is secured by means of the nut 178 to the threaded shank of a bolt constituting terminal 109 in the upper semicircular array. This bolt thus concurrently functions as both a common terminal, and as a tap point for contact by the rotary wiper arm plate A as hereinafter described.

At the opposite side of the terminal plate 162, a cotter key 180 is extended through the shaft, and a helical compression spring 182 is positioned between the cotter key and a washer 184 which bears against the rotary wiper arm plate A. The rotary wiper plate A is keyed to the shaft 170 for rotation therewith, but is axially movable on the shaft so that it is continuously biased axially along the shaft by the resilient urging of the compression spring 182. The rotary wiper plate A is configured at its apertured outer end so that it can make selective contact with the rounded heads of the terminal bolts 101–109 arrayed in a semicircle, and positioned on that side of the terminal plate 162 which faces toward the web portion 156 of the frame 154. The rotary wiper arm plate A bears against, and is in contact with, an electrically conductive common terminal plate 188 which is secured at its outer end to, and is in electrical contact with, one of the bolts constituting terminal 110.

The end portion of the shaft 170 which projects on the opposite side of the web plate 156 from the terminal plate 162 is journalled through a hub 190 which is connected to the web portion 156 of the mounting plate 154, and supports an apertured position indicator plate 192. It will be noted in referring to FIG. 8 that the apertured position indicator plate 192 carries a plurality of semicircularly arrayed position apertures, and that a plurality of numerical indicia are placed adjacent these apertures so that they are numbered from "1" to "9".

At its outer end, the shaft 170 carries a handle assembly 194 which includes an elongated handle 196 keyed to the shaft 170 so that rotation of the handle will cause rotation of the shaft 170. The handle 196 carries a threaded locking bolt 198 which is threaded through the handle adjacent an end thereof which is opposite the indicator plate 192 so that the locking bolt, during rotation of the handle 196, is consecutively aligned with one of the position apertures 1–9 in the indicator plate 192. On the opposite side of the point at which the handle 196 is connected to the shaft 170 from the end of the handle which carries the locking bolt 198, the handle carries a stop pin 200. The stop pin 200 is positioned to contact one of the lower edges of the indicator plate 192 when the handle 196 is rotated on the shaft 170 to such position for contact. This limitation on the extent of rotation which the handle 196 can undergo assures that the rotary wiper arm plate A will not be permitted to rotate, as the handle is turned, to a point where it passes the extreme terminals 101 and 109 in the semicircular array of terminals at the upper side of the terminal plate 162. The limiting action of the stop pin 200 also similarly limits the rotary wiper arm plate B to movement across the bolt heads constituting parts of the terminals 110–118 disposed in semicircular array around the bottom portion of the terminal plate 162.

The tandem rotary switch 28 is constructed similarly to the switch 26. Thus, the switch includes a terminal plate 202 secured by an angle bracket 204 to the intermediate leg 160 of the F-shaped supporting frame 154. The terminal plate 202 is made of a suitable electrically non-conductive material. A series of bolts having threaded shanks are used as contacts or terminals, and a semicircular array of spaced bolts project through the upper portion of the terminal plate 202, and constitute terminals 119–127 as hereinbefore described. Oppositely projecting bolts are extended through the lower portion of the terminal plate in semicircular array and constitute terminals 128–137 as hereinbefore described.

A switch shaft 206 of electrically non-conducting material is extended through suitable journals or bearings in both the web portion 156 of the frame 154 and the center of the terminal plate 202. The outer end of the shaft 206 is retained in position through the terminal plate by means of a cotter key 208 extended through the shaft 206 and bearing against a washer 210 as shown in FIG. 10. The washer 210 in turn bears flatly against the rotary wiper arm plate C which is constructed of copper or other suitable electrically conductive material, and is keyed to the shaft 206 for rotation therewith. It will be noted that the apertured outer end of the wiper arm plate C is configured and positioned to selectively contact the rounded head of one of the bolts which form the terminals 128–136 spaced in semicircular array around the lower portion of the terminal plate 202. The rotary wiper arm plate C bears flatly against a fixed common terminal plate 212 which does not rotate with the shaft 206 and extends outwardly and is secured at its outer end by means of nut 214 to the threaded shank of a bolt constituting terminal 127 in the upper semicircular array of terminals. The common terminal plate 212 is, of course, of an electrically conductive material.

At the opposite side of the terminal plate 202, a cotter key 216 is extended through the shaft 206, and a helical compression spring 218 is positioned between the cotter key and a washer 220 which bears against the rotary wiper arm plate D. The rotary wiper arm plate D is keyed to the shaft 206 for rotation therewith, but is axially movable on the shaft so that it is continuously resiliently biased axially along the shaft toward the terminal plate 202 by the resilient urging of the compression spring 218. The rotary wiper arm plate D is configured at its outer end so that it can make selective individual contact with the rounded heads of the terminal bolts 119–127 arrayed in a semicircle and positioned on that side of the terminal plate 202 which faces toward the web portion 156 of the frame 154. The rotary wiper arm plate D bears against, and is in contact with, an electrically conductive common terminal plate 222 which is secured at its outer end to, and is in electrical contact with, one of the bolts constituting terminal 128.

The end portion of the shaft 206 which projects on the opposite side of the web plate 156 from the terminal plate 202 is journalled through a hub 224 which is connected to the web portion 156 of the mounting plate 154, and supports an apertured position indicator plate 226. It will be noted in referring to FIG. 8 that the apertured position indicator plate 226 carries a plurality of semicircularly arrayed position apertures, and that a plurality of numerical indicia are placed adjacent these apertures so that they are numbered from "1" to "9".

At its outer end, the shaft 206 carries a handle assembly designated generally by reference numeral 228. The handle assembly 228 includes an elongated handle 230 keyed to the shaft 206 so that rotation of the handle will cause rotation of the shaft. The handle 230 carries a threaded locking bolt 232 which is threaded through the handle adjacent an end thereof which is opposite the indicator plate 226. The locking bolt 232, during rotation of the handle 230, is consecutively selectively aligned with one of the position apertures "1" to "9" in the indicator plate 226.

The switch assembly made up by the tandem rotary switches 26 and 28 is mounted upon the housing 10 of the transformer so that the switch handles 196 and 230 are accessible on the outer side of the housing as shown in FIG. 1. The leads from the secondary subwindings S-A and S-B and constituting leads 101-118 (included in the generically described group of leads 22) are brought up from the coiled subwindings to the location of the bolts constituting the terminals 101-118 on the terminal plate 162. Here the ends of these leads are connected to the terminal bolts by the use of the nuts carried on the threaded shanks of these bolts. It will be noted in referring to the manner in which the switch 26 is constructed that the leads 110-118 are brought up and secured at their ends on one side of the terminal plate 162, while the leads 101-109 are brought upwardly in the housing 10 and secured on the opposite side of this terminal plate. Ease of installation and connection of the transformer leads, and ready access to them with clear identification, are therefore characteristic of the switch construction and method of its use in the transformer.

In similar fashion, the leads 128-136 from the subwinding S-C are brought upwardly within the housing 10 and the ends thereof secured to the bolt terminals 128-136 secured in semicircular array around the lower portion of the terminal plate 202. The leads 119-127 are extended upwardly and are secured to the bolt terminals 119-127 at the opposite and upper side of the terminal plate 202.

It has previously been explained that in the operation of the transformer of this invention, as illustrated by that embodiment of the transformer which includes the two pairs of secondary subwindings S-A and S-B, S-C and S-D, the rotary tandem switch 26 works by rotating the wiper arms A and B thereof in synchronism, so that corresponding terminals or contacts on the several leads are contacted in each rotary position of the switch. This is accomplished in the switch embodiment illustrated in FIGS. 7–10 by rotating the switch handle 194 to a point where the locking bolt 198 is positioned opposite one of the apertures "1"–"9" in the indicator plate 192. It will be perceived that the nine positions constituted by these nine apertures correspond to the nine possible positions of the wiper arms A and B of switch 26 as shown in FIG. 5. Correspondingly, there will be a different selected secondary output voltage developed at the terminals X1 and X2 as the handle 194 is rotated to a selected one of the "1" through "9" positions. The locking bolt 198 can then be threaded farther through the handle and into the selected one of the aligned apertures "1"–"9" in the indicator plate 192. Suitable informational indicia are provided upon a data plate (not shown) secured to the outside of the transformer 10 to permit the operator to determine the position to which the handle 194 should be moved in order to deliver a certain voltage at the terminals X1 and X2 by selective interconnection of segments of the subwindings S-A and S-B in the manner hereinbefore described, and as shown in FIG. 6.

It will be noted that in the method of connecting the leads 101-118 from subwindings S-A and S-B which has been hereinbefore described, the lead 86 between the wiper arm A and the terminal 110 as schematically illustrated in FIG. 5, corresponds to the non-moving common terminal plate 188. The stationary common terminal plate 176, on the other hand, functions to constantly interconnect the wiper arm plate B with the terminal 109. The shaft 170 to which the movable wiper arm plates A and B are connected for concurrent rotation corresponds to the mechanical linkage 78 schematically illustrated in FIG. 5 of the drawings.

It is believed that the foregoing description of the manner in which the tandem rotary switch 26 is operated and is constructed will provide sufficient illustration of the manner in which the tandem rotary switch 28 is constructed and operates. The wiper arm plates C and D are concurrently moved to corresponding selected positions of contact with selected ones of the terminals 119-136 and this switch is also characterized in having stationary common terminal plates 222 and 212 which link the wiper arm plates D and C with the terminals 128 and 127 in correspondence to the leads 97 and 94, respectively, as schematically illustrated in FIG. 5.

It should further be pointed out that the leads 82 and 88 which project from the terminals 101 and 118 to the secondary output terminals X1 and X2 are located in the upper portion of the housing 10 of the transformer, and extend from terminals 101 and 118, as carried on the terminal plate 162, upwardly to a point where they are secured to portions of the terminals X1 and X2 located on the inner side of the housing 10. The same arrangement is characteristic of the leads 96 and 98 which project from terminals X3 and X4 mounted on the upper side of the housing 10 of the transformer. It will be perceived that the projection of the secondary output terminals X1-X4 on the outer side of the housing 10 of the transformer permits a series or parallel external interconnection of the paired subwindings S-A, S-B and S-C, S-D when it is desired to further vary the output voltage of the transformer, or to selectively interconnect and employ one or both pairs of the secondary subwindings.

The compound tandem rotary switch assembly illustrated in FIGS. 7–10 of the drawings provides the clear advantage of compact construction in which the terminals connected to the several leads from the secondary subwindings are commonly carried on terminal plates and are oriented thereon so that the leads can be extended to the points of connection to the terminals without interference with each other, and in a way to facilitate rapid and immediate identification. The wiper arms of the two rotary tandem switches are commonly carried on a non-conducting shaft for concurrent, synchronized movement, and the switch assembly is constructed in a way which permits certain common conductor plates to be connected to a bolt type terminal which therefore functions both as an anchor point for the common plate, and as a tap point for the movable wiper arm located on the opposite side of the terminal plate.

A single compressive member or spring is employed on each of the shafts of the two switches to maintain both wipers in a constantly biased status in which both are in contact with the common plates on opposite sides of the terminal plate, and are also spring-loaded so as to assure consecutive or sequential contact, during rotation, with each of the rounded bolt heads constituting the terminals. In this regard, it should be pointed out that the apertures which are provided in the ends of the wiper arms A-D provide a sensory indication to the operator of the switch assembly when contact is made between the wiper arm and the terminal as the aperture slips over and mates with the rounded heads of the bolts used as terminals. The two shafts employed on the switches 26 and 28, in extending through a common frame, assure that rotation of the handles connected to these shafts will not cause rotation or movement of either terminal plate and associated terminals and wiper arms forming the remaining portions of the switch as associated with each of the two shafts.

A different embodiment of the compound tandem rotary switch assembly utilized as a part of the transformer of the invention is illustrated in FIGS. 11–16. The compound tandem rotary switch assembly there illustrated is designated generally by reference numeral 240 and is shown mounted within a section of the wall of the housing 10 of the transformer. The switch assembly 240 includes a single elongated indicator plate 242 which replaces the two indicator plates 192 and 226 in the embodiment of the switch assembly shown in FIGS. 7–10, and as such includes the two sets of position apertures "1"–"9" as hereinbefore described.

Projecting through suitable journal hubs 244 and 246 secured to the housing 10 are shafts 248 and 250, respectively, which form parts of the respective tandem rotary switches 26 and 28. The shaft 248 is connected at it end on the outer side of the housing 10 to a handle 252, and the shaft 250 is similarly connected to a handle 254, also disposed on the outer side of the housing. As previously described in referring to the switch assembly shown in FIGS. 7–10, each of the handles 252 and 254 carries a threaded locking bolt 256 which can be extended into registering position apertures in the indicator plate 242 as the handles are rotated to selected switching positions.

On the opposite side of the wall of the housing 10 from the indicator plate 242, the shaft 250, after projection through the journal hub 246, is keyed to a hub 258. The hub 258 is connected by four radial spokes or web elements 260 to a large annular wiper ring supporting plate 264. The hub 258, spokes 260 and wiper ring supporting plate 264 are constructed of an electrically non-conductive material, and are preferably molded integrally as a single piece. The wiper ring supporting plate 264 carries on its side opposite the hub 258, an annular flange 266 which extends normal to the plane of the wiper ring supporting plate. The flange 266 is provided with a plurality of lugs 268 which function conjunctively with the flange in retaining a pair of generally semicircular wiper rings 270 and 271 of electrically conductive material in a peripherally extending position around the outer edge of one side of the wiper ring supporting plate 264. One of the ends **270*a* and 271*a* of each of the wiper rings 270 and 271 is stopped against a stop flange 272 by turning such end portion of the wiper ring upwardly through a recess in the plate 264 at this location (see FIG. 12**).

An end portion **270*b* of the wiper ring 270 opposite the end 270*a* is bent radially inwardly at an angle, passes through an accommodating gap in the annular flange 266, and has a contact end portion 270*c* which projects radially inwardly to the inner edge of the plate 264 and is there retained between a pair of studs 276 formed on the side of this plate 264 which is opposite the hub 258**.

It may be noted at this point in the discussion that the semicircular wiper rings 270 and 271 correspond to the wiper arms C and D of the switch 28 and this correspondence will be better understood upon the subsequent discussion of the compound switch assembly 240 under discussion. It will also be noted in referring to FIG. 13 that the respective wiper ring ends **270*a* and 271*b* and 270*b* and 271*a* are electrically isolated from each other by the stop flanges 272**.

The tandem rotary switch 28 further includes an electrically non-conductive synthetic resin terminal ring, designated generally by reference numeral 280. The terminal ring 280 includes a circular terminal anchoring band 282 which is of circular cross-section and of a diameter which is slightly greater than the inside diameter of the plate 264 so as to extend under the ends **270*c* and 271*c* of the wiper rings 270 and 271. A series of angularly spaced, radial insulating fins 284 project radially outwardly from a shaft-receiving central hub 286 which is rotatably mounted around the shaft 250 on the opposite side of the plate 264 from the hub 258. The terminal ring 280, fins 284 and hub 286 are preferably integrally molded, and are resiliently biased toward the wiper ring supporting plate 264 by a compression spring 287, which bears against the hub 286, and a retainer key 288 extended through shaft 250**.

Figure 11:
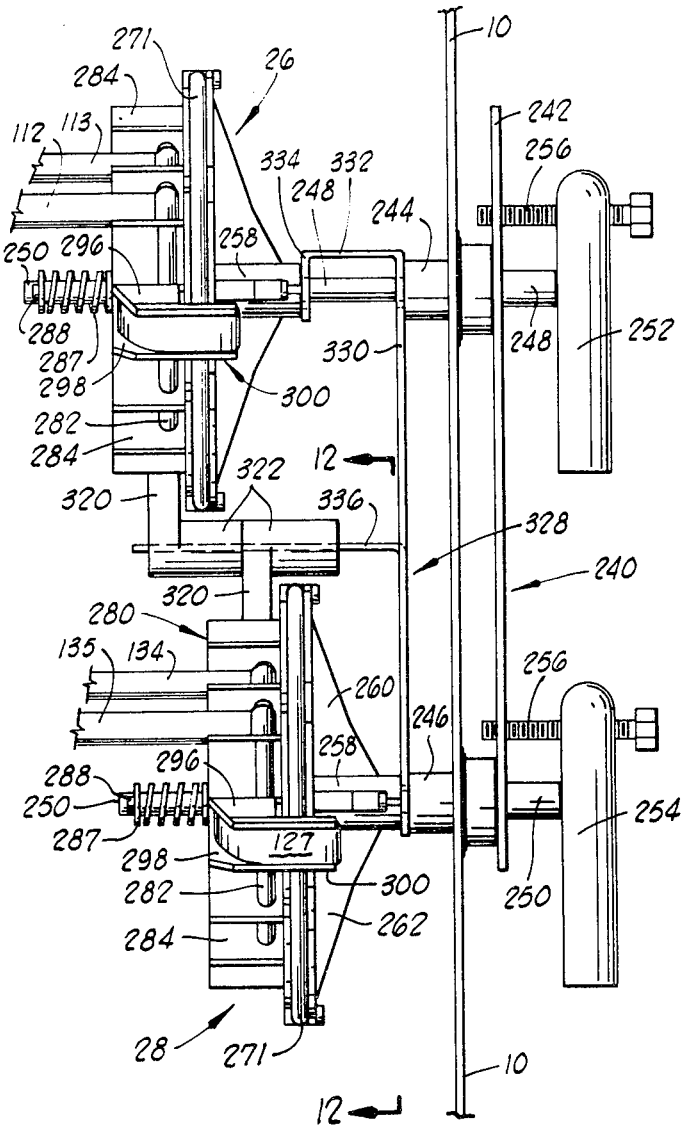
FIG. 11 is a side elevation view of a different embodiment of a compound rotary tapping switch which can be utilized in the tranformer of the present invention.
Figure 14:
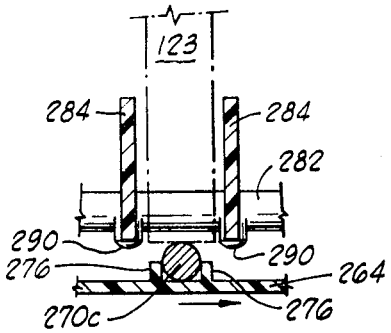
FIG. 14 is a sectional view taken along line 14—14 of FIG. 13.
Figure 13:
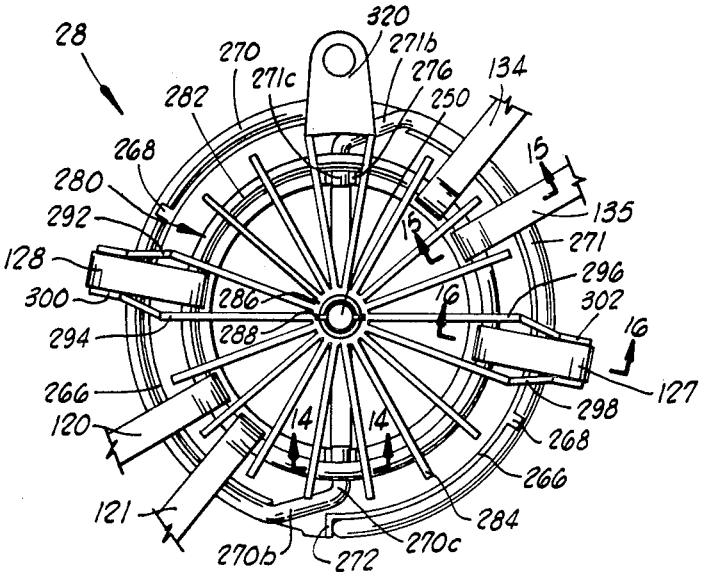
FIG. 13 is a rear elevation view of one of the two rotary tandem switches utilized in the compound rotary tapping switch shown in FIG. 11.

Near their outer ends, each of the radial insulating fins 284 is secured to the terminal anchoring band 282 in the manner best illustrated in FIGS. 11, 13 and 14. It will be noted in referring to FIG. 14 that each radial insulating fin 284 is joined to the terminal anchor ring 282 at a location where the terminal anchor ring is provided with a cam stud 290 having a rounded surface facing the side of the wiper ring plate 264 which carries the semicircular wiper rings 270 and 271.

Figure 16:
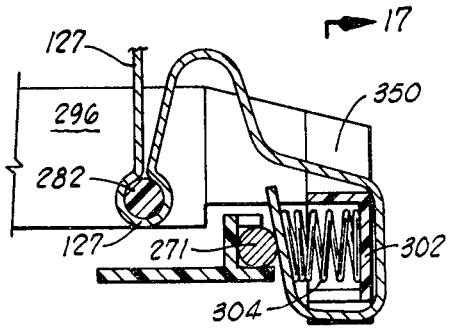
FIG. 16 is a sectional view taken along line 16—16 of FIG. 13.

Two pairs of angularly spaced, common conductor insulating vanes radiate outwardly from the hub 286, and include vane pair 292 and 294, and vane pair 296 and 298. At their radially outer ends, the common conductor insulating vanes 292 and 294 carry a retaining toe 300 which projects normal to the plane of the wiper ring plate 264 and extends across the outer periphery of this plate as shown in FIGS. 11 and 16. An identical retaining toe 302 is carried at the radially outer ends of insulating vanes 296 and 298. Each of the toes 300 and 302 has a hollow interior in which is located a resilient helical compression spring 304 (see FIG. 16). The location of the compression spring 304 in the respective hollow retaining toes 300 and 302 is immediately opposite one of the semicircular wiper rings 270 or 271.

Figure 17:
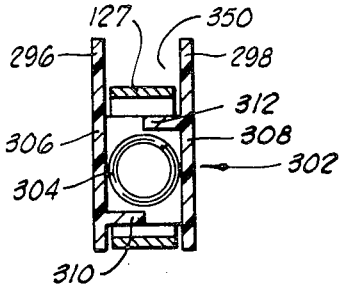
FIG. 17 is a sectional view taken along line 17—17 of FIG. 16.

As shown in FIG. 17 of the drawings, each of the hollow toes 300 and 302 is defined by substantially parallel wall portions 306 and 308 which carry inwardly projecting ribs 310 and 312, respectively. At one of their sides, the wall portions 306 and 308 are joined to a respective pair of the common conductor insulating vanes 292 and 294 or 296 and 298 (see FIG. 17). This construction permits each of the hollow toe portions to be integrally formed with the respective common conductor insulating vane pair by an injection molding procedure.

A locking boss 320 is molded integrally with a pair of the radial insulating fins 284 of the terminal ring 280 and projects radially outwardly from the outer ends of the fins 284. The locking boss 320 carries a hub 322 at its outer end which includes a bore which extends substantially parallel, in its longitudinal dimension, to the axes of the shafts 248 and 250 for the purpose of receiving a flange of a spacing and locking structure hereinafter described.

The tandem rotary switch 26, a portion of which has been hereinbefore described, is constructed substantially identically to the tandem rotary switch 28 insofar as the wiper ring supporting plate, semicircular wiper rings and synthetic resin terminal ring are concerned. Moreover, the identity further extends to the employment of an identical compression spring around a shaft 248 and retained in a biasing position by means of an identical retainer key, also as characteristic of the switch 26. For the foregoing reasons, identical reference numerals have been used on such identical parts as they are chharacteristic of identical structural elements of switches 26 and 28.

The synthetic resin terminal rings 280 of the two switches 26 and 28 are prevented from undergoing rotation upon rotation of shafts 248 and 250 by means of a locking and spacing structure designated generally by reference numeral 328. The locking and spacing structure 328 includes an angulated plate 330 which has a bent over, slotted or bifurcated end portion 332. The end portion 332 includes parts disposed on opposite sides of a slot, which parts pass around or straddle the shaft 248. The plate 330 bears against one side of the hub 244 opposite the housing 10, and a down-turned end portion 334 of the locking and spacing structure 328 bears against the hub 258 of the switch 26. A locking flange 336 is secured to and extends from the central portion of the plate 330 and functions to interlock the bored hubs 322 of the locking bosses 320 of each of the switches 26 and 28 to each other so that the switches are retained in their positions in relation to each other, and the synthetic resin terminal rings 280 thereof are thereby interlocked against rotation with either of the shafts 248 or 250 of the switches 26 and 28 when these switches are operated by rotating the handles 252 and 254, respectively. The lower end of the plate 330 is also slotted so that it can be slipped over the shaft 250 and abutted against a side of the hub 246.

With the compound tandem rotary switch assembly 240 mounted in the housing 10 of the transformer in the manner illustrated in FIG. 11, the leads from the several tapped points on the two pairs of secondary subwindings can then be extended upwardly and connected to the appropriate points on the switch assembly. The stationary synthetic resin terminal rings 280 are employed for this purpose. Since the mode of connection of the leads 101-136 to the terminal rings 280 of the two switches 26 and 28 is substantially identical, reference to this mode of connection will be made by referring only to the switch 28.

Figure 15:
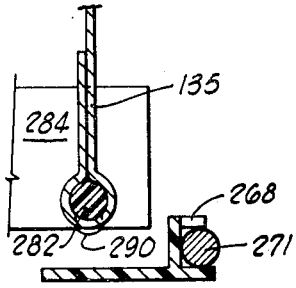
FIG. 15 is a sectional view taken along line 15—15 of FIG. 13.

As hereinbefore explained, the switch 28 controls the manner in which the several tapped sections within subwindings S-C and S-D are interconnected through selectively dimensioned paralleled sections. The leads from these tapped sections within these subwindings are those denominated by reference numerals 119-136. Several of these leads are illustrated as connected in FIGS. 12–16 of the drawings. It may first be commented, however, that in interconnecting the leads 101-136 to the terminal rings 280 of the switches 26 and 28, a flat copper conductor is preferably made to constitute each lead extending from the respective subwindings S-A through S-D, and this flat copper conductor is brought up to the location of the respective terminal ring and bent around one section of the anchoring band 282 which is located between an adjacent diverging, angularly spaced pair of the radial insulating fins 284. This arrangement is illustrated in FIGS. 13–15 of the drawings.

After the flat conductor is reverse bent through an angle of 180° or more so as to, in effect, be hooked over the terminal anchoring band 282, the end portion may be cut away leaving only the bight or loop which engages and hooks over the anchoring band. A sufficiently large number of the angularly spaced, radial insulating fins 284 is provided to accommodate all of the leads from the respective sections of the subwindings S-C and S-D, and an equivalent number of radial insulating fins is provided in the terminal ring 280 of the switch 26 for the purpose of receiving and accommodating the leads 101-118 from the subwindings S-A and S-B.

Figure 12:
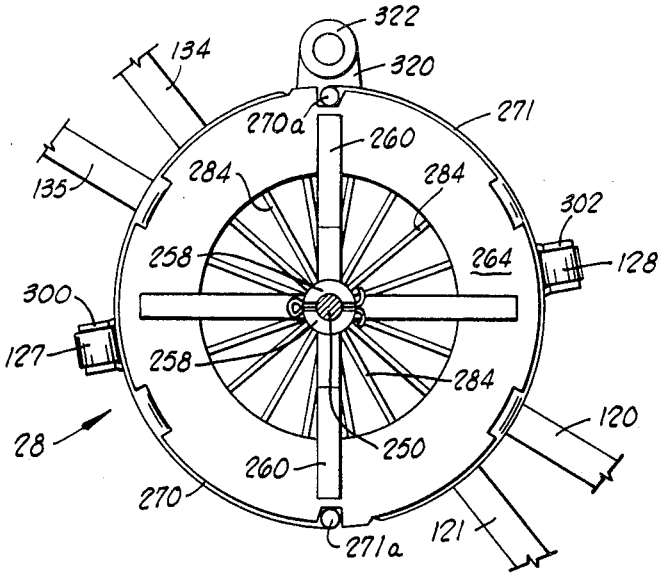
FIG. 12 is a sectional view taken along line 12—12 of FIG. 11.

In FIGS. 12 and 13 of the drawings which depict oppositely facing views of a portion of the switch 28, the leads 134, 135, 120 and 121 are shown attached to the anchoring band 282 of the terminal ring 280, and such securement of these leads to the anchoring band is typical of the manner in which all of the remainder of the leads are secured thereto when all leads are connected to the terminal ring. Leads 112 and 113 are shown connected to the anchoring band 282 of the terminal ring 280 of switch 26 in FIG. 11.

In the case of the leads 127 and 128, the schematic illustration in FIG. 5 of the drawings shows that these leads are connected via their respective tap point terminals through the common leads 94 and 97, respectively, to the wiper arms C and D, respectively. In the switch construction under discussion, a single flat copper conductor element is employed as the only electrical lead extending from the tap point on the two subwindings S-D and S-C to which the leads 127 and 128 are connected, through the terminal points on the switch 28 as located for contact by the movable wiper rings 270 and 271, and on to the point of function as a common lead for constantly interconnecting the terminals 127 and 128 to points on the respective wiper rings. Thus, in referring particularly to FIG. 16, it will be noted that the lead 127 from subwinding S-C is brought up to the anchoring band 282 of the terminal ring 280, is then reverse bent around this anchoring band, and then is again bent through a relatively large angle in a reverse direction so as to permit the copper conductor to be extended on through the slot 350 provided at one side of the toe 302 and between the arms 296 and 298. From this location, the conductor is extended around the toe and back inside the toe to a position in which an end portion of the flat copper conductor is biased by the compression spring 304 into sliding contact with the semicircular wiper ring 271. Thus, as the wipe ring 271 is rotated with the wiper ring supporting plate 264, constant contact is maintained between the wiper ring and the common electrical lead constituted by the flat copper conductor which dually functions as the lead 127.

The same method of connection and characteristics is true of the flat copper conductor which functions as the lead 128, provides a tap point on the switch 28 for contact with the movable semicircular wiper ring 271 and also constitutes the equivalent of the common lead 97 which extends to the wiper arm D in FIG. 5.

It will be apparent from the foregoing discussion that in the construction of the switch under discussion, the semicircular wiper rings 270 and 271 correspond in their operation to the movable wipers or taps D and C of switch sections **28*a* and 28*b* in the schematic illustration of FIG. 5. It will also be apparent that the shaft 250, in causing rotation of the wiper ring supporting plate 264, and with it, the semicircular wiper rings 270 and 271, is the equivalent of the mechanical linkage 100 shown schematically in FIG. 5**.

For the purpose of consecutively contacting the terminals 119-127 and 128-136 located at the ends of the corresponding leads, the contact end **270*c* of wiper ring 270 and the contact end 271*c* of the wiper ring 271** are positioned to move into consecutive or sequential contact with the turned over end portions of the leads 119-127 and 128-136 constituted by the flat conductors. This relationship is illustrated in FIGS. 13 and 14 of the drawings. In FIG. 13, the lead 123 has been removed from the anchoring band 282 in order to show the manner in which the contact end 270c of the wiper ring 270 extends inwardly over the anchoring band. In FIG. 14, however, the flat copper conductor constituting the lead 123 is illustrated in phantom, and it is perceptible from this figure of the drawings that the turned over end portion of this lead, in passing around the anchoring band 282 between the spaced radial insulating fins 284, is sufficiently protuberant to make contact with and bear against the contact end portion 270c of the wiper ring 270.

As the wiper ring supporting plate 264 undergoes rotation with the shaft 250 in the direction of rotation illustrated by the arrow in FIG. 14, it will be noted that the wiper ring contact end portion 270c is caused to move in consecutive sequence off the respective flat copper conductor lead 123, up over the cam stud 290, and then back down into contact with the next adjacent flat copper conductor constituting the terminal of the next lead in the spaced sequence of leads connected to the subwinding S-D. At the same time that the wiper ring 270 is undergoing this movement to concurrently move the contact end 270c thereof from lead terminal to lead terminal, the same action is imparted to the wiper ring 271 also carried on the plate 264. Thus, the wiper rings are moved in synchronism and function in the manner previously attributed to the wiper arms C and D of the switch 28. At all times the common leads constituted by the flat copper conductors which also integrally include the leads 127 and 128 are continuously contacted by the wiper rings as a result of the arrangement shown in FIG. 16 and hereinbefore explained.

The same type of construction and mode of operation characterize the switch 28 constituting the uppermost switch in the compound tandem switch assembly 240 shown in FIG. 11.

The compound rotary tandem switch assembly 240 illustrated in FIGS. 11–17 constitutes a preferred embodiment of switch assembly useful in the transformer of the invention. It will be perceived from the foregoing description of the manner in which the leads from the secondary subwindings are connected to the switch assembly for the purpose of forming self-constituting terminals and tap points thereon, that this switch assembly eliminates the need to employ brass bolts and nuts as terminals as is done in the case of the embodiment shown in FIGS. 7–10. Electrical contact and interconnection is thus improved vis-a-vis the need to establish contact through brass elements. The cost of manufacturing the switch assembly is also thereby substantially reduced.

Further, the method by which the ends of the flat copper conductors constituting the leads from the secondary subwindings are connected to the terminal anchoring band 282 permits very rapid hook-up and positive connection of terminals to the internally mounted switches in the housing 10 of the transformer. Considerable labor is thus saved by this aspect of the switch construction.

It is also noted that a unique aspect of the switch assembly constituting the preferred embodiment of the invention is that a single electrically conductive lead functions both as the lead directly out of the subwindings of the transformer to the extreme terminals in the portions of the switch which are associated with the two movable taps or wiper rings, and that this same electrical conductor then functions as the common by which these terminals are interconnected electrically to the two synchronously operated wiper rings.

The manner in which the synthetic resin terminal ring 280 constituting a major subassembly of the compound rotary tandem switch assembly is constantly biased by a single compression spring acting on a centrally disposed hub of this terminal ring also affords advantage. Thus, the effect of the resilient bias developed by the spring is to exert a constant force which is ultimately brought to bear on the two contact tap points at which the contact ends 270c and 271c of the wiper ring are in contact with two of the terminals formed by the ends of the two leads which are interconnected by the tandem switch at any time. The bias of the spring thus acts at two points around the synthetic resin terminal ring 280 which are spaced 180° from each other and, with the hub 286, constitute three spaced points of forced contact, thus distributing the mechanical forces forcing the terminal ring and wiper ring carrying plate against each other over a large well-distributed area, with yet a minimum of frictional drag imposed on the turning wiper ring supporting plates.

Another aspect of the compound switch assembly is that by reason of the use of radial insulating fins 284 having a relatively large axial dimension, the tubular insulating sleeves which extend upwardly from the tapped sections of subwindings around the lead conductors can be brought all the way up along the conductors to a location where these sleeves can be terminated between spaced adjacent insulating fins between which the respective sleeved conductor extends. this assures complete and effective insulation of each lead conductor from every other lead conductor.

The common conductors, at the point where they are turned over the toes 300 and 302 and back into a location contiguous to the wiper rings 270 and 271, are each independently and continuously spring biased into contact with the respective wiper rings, thus assuring long and effective service life of the switch assembly without failure of contact between the wiper rings and the common conductors. The manner in which the cavities or hollow interiors of the toes 300 and 302 are formed for the accommodation of the compression springs 304 assures that these cavities can be formed by injection moding concurrently with the formation of the rest of the synthetic resin structures constituting the terminal rings 280.

It will also be observed that the provision of the cam studs 290 between adjacent conductor terminals at the location where the conductors are bent around the anchoring band 282 assures that there will be sensory indication to an operator of the switch of the time that the position of the wiper rings is changed to move from one tap point to another. Thus, snap action is imparted to the incremental movement of the several wiper rings as a result of the inclusion of the cam studs 290 in the path of travel of the contact ends of these rings. Moreover, the provision of these cam studs also causes the switch to operate so that contact between the contact end of the respective wiper ring and the lead terminal is completely broken before the contact end of the respective wiper ring is able to touch the conductor at the next tap point.

Figure 7:
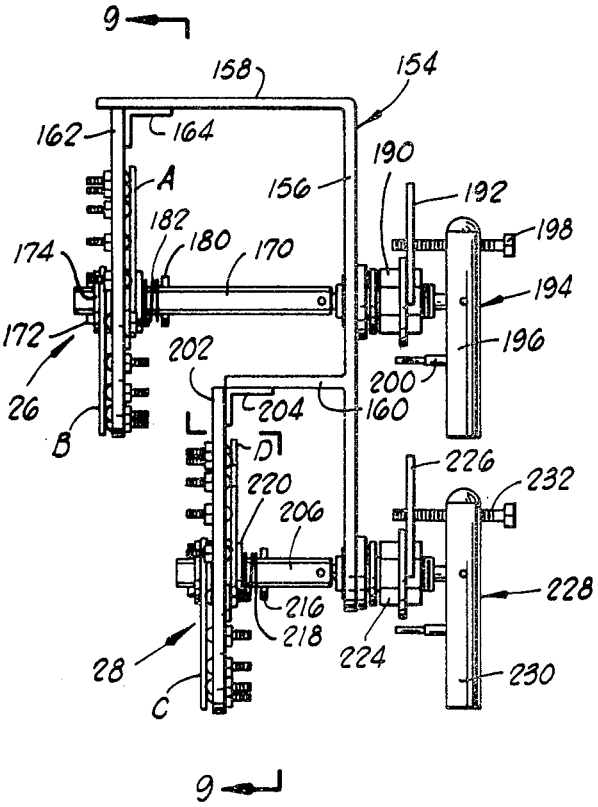
FIG. 7 is a side elevation view illustrating one type of compound tandem rotary tapping switch employed in the transformer of the present invention.
Figure 8:
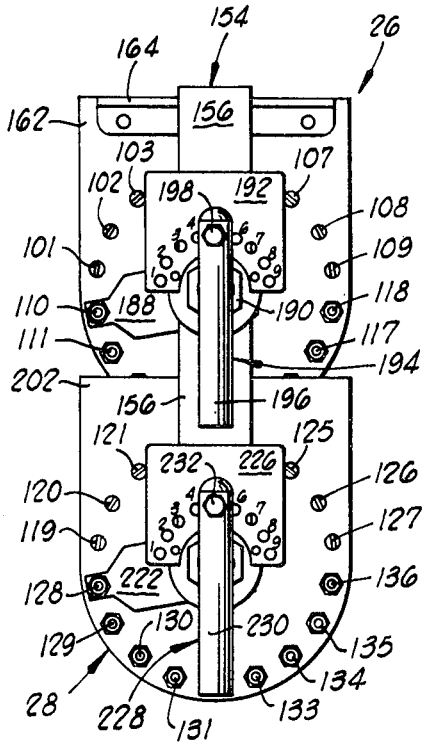
FIG. 8 is a front elevation view of the tapping switch illustrated in FIG. 7.

Finally, an important aspect and advantage of the switch assembly 240 illustrated in FIGS. 11–17 is that there is no need to provide stop fingers or similar stop elements of the type shown at 200 in FIG. 7. This is because even though the handles 252 and 254 of the switches 28 and 26 are rotated past the place where their respective locking bolts 256 are aligned with one of the nine apertures associated therewith in the indicator plate 242, such over-rotation will only carry the complementary wiper elements 270 and 271 mounted on the wiper ring supporting plate 262 into contact with the next adjacent series of contact terminals carried on the anchoring band 282 of the terminal ring 280. In other words, the transformer will remain energized, and an output voltage will be delivered despite such over-rotation, as contrasted with the transformer becoming inoperative or being damaged or broken because of over-rotation, as in the case of the embodiment of the switch assembly illustrated in FIGS. 7–10.

The transformer of the invention is particularly useful in oil field work and is very adaptable to the exigencies of those situations in areas where secondary voltage requirements may vary widely. The transformer and control device of FIG. 1, for a selected source voltage input, may be utilized, for example, to increment continuously through equal, 60-volt steps an output of from 480 volts to 1920 volts. These figures will apply for a given input voltage, and it should be understood that the similar range for any selected voltage values is attainable by variation of the basic device design. Also, it should be understood that for any given voltage requirements, the voltage transformation can be reversed, with terminals X1-X4 receiving input voltage to provide an output voltage across terminals $H_1$ and $H_2$.

Although certain preferred embodiments of the transformer device of the invention have been herein described and illustrated in the accompanying drawings, it will be understood that various changes and innovations can be made in the illustrated and described structures without departure from the basic principles which underlie the invention. Changes and innovations of this type are therefore deemed to be circumscribed by the spirit and scope of the invention, except as the same may be necessarily limited by the appended claims or reasonable equivalents thereof.

What is claimed is:

1. A compound tandem rotary switch for selectively concurrently interconnecting multiple sections of two pairs of tapped electrical conductors having leads extending from each conductor at opposite ends of the multiple sections thereof, said switch comprising:

a pair of terminal supporting subassemblies each having spaced connecting situses thereon for physically connecting a plurality of said leads thereto from each of said electrical conductors in one pair of said conductors, with the leads of one pair of conductors being connected to one of said terminal supporting subassemblies, and the leads from the other of said pair of electrical conductors being connected to the other of said terminal supporting subassemblies, said terminal supporting subassemblies each further including:

means for electrically insulating each of said situses from the other situses; and means for retaining a pair of common electrically conductive elements in spaced positions in which each of said common electrically conductive elements extends between one of said situses and a wiper contacting position remote from said one situs;

a pair of electrically conductive movable wiper means adjacent each of said terminal supporting subassemblies, and each having a portion thereof located at one of said wiper contacting positions for contact with a common electrically conductive element;

means for electrically insulating the electrically conductive movable wiper means in each pair of said wiper means from each other;

means for concurrently moving the electrically conductive movable wiper means in each pair of said movable wiper means in consecutive sequence between said connecting situses of the respective terminal supporting subassembly associated with the respective pair of electrically conductive movable wiper means; and means for physically interconnecting said terminal supporting subassemblies to each other to position and orient the connecting situses of each terminal supporting subassembly at locations such that leads from each of said tapped electrical conductors, and at opposite ends of each of the multiple sections thereof, will extend substantially parallel to and be spaced from leads from each of the other electrical conductors, and at the respective opposite ends of respective multiple sections thereof, when said leads are connected to the connecting situses of said terminal supporting subassemblies.

2. A compound tandem rotary switch as defined in claim 1 wherein each of said terminal supporting subassemblies comprises a terminal ring of electrically non-conducting material including:

an annular anchor band;

a central hub at the center of said anchor band; and a plurality of angularly spaced, divergent radially extending insulating fins extending from said hub to said anchor band, said insulating fins defining with said anchor band said spaced connecting situses and constituting said means for electrically insulating each of said situses from the other situses.

3. A compound tandem rotary switch as defined in claim 1 wherein each of said situses comprises a threaded bolt having a nut threaded thereon.

4. A compound tandem rotary switch as defined in claim 1 and further characterized as including means for locking said concurrently moving means in a selected position for selectively disposing said wiper means at chosen connecting situses in contact with the leads connected to said chosen connecting situses.

5. A compound tandem rotary switch as defined in claim 1 wherein each of said terminal supporting subassemblies comprises a terminal plate of electrically non-conductive material having the connecting situses for connecting the leads from one of said tapped electrical conductors in one pair thereof on one side of said terminal plate, and having the connecting situses for connecting the leads from the other tapped electrical conductor in said one pair thereof located on the other side of said terminal plate.

6. A compound tandem rotary switch as defined in claim 5 and further characterized as including a first common conductor plate extending from one of said situses to a wiper contacting position and located on one side of said terminal plate; and a second common conductor plate extending from a second of said situses to a wiper contacting position on the opposite side of said terminal plate from said first common conductor plate.

7. A compound tandem rotary switch as defined in claim 6 wherein said pair of wiper means comprises:

a first rotary wiper plate contacting said first common conductor plate and disposed on said one side of said terminal plate for movement relative to said terminal plate; and a second rotary wiper plate contacting said second common conductor plate and disposed on said opposite side of the terminal plate for movement relative to said terminal plate.

8. A compound tandem rotary switch as defined in claim 2 and further characterized as including, in association with each of said terminal supporting subassemblies:

a first common conductor integrally formed with one of said leads as a unitary structural element and extending from one of said tapped electrical conductors in one of the pairs thereof to one of said situses, and from said one situs to one of said wiper contacting positions; and a second common conductor integrally formed with another of said leads as a unitary structural element and extending from the other of said electrical conductors in said one pair to another of said situses, and from said other situs to another of said wiper contacting positions.

9. A compound tandem rotary switch as defined in claim 8 and further characterized as including means resiliently biasing each of said first and second common conductors into contact with different ones of said movable wiper means.

10. A compound tandem rotary switch as defined in claim 1 wherein said pair of wiper means comprises a pair of semicircular, spaced electrically conductive wiper rings; and wherein said means for electrically insulating said wiper means from each other comprises an electrically non-conductive wiper ring supporting plate having said wiper rings mounted thereon in substantially coplanar spaced relation.

11. A compound tandem rotary switch as defined in claim 1 and further characterized as including means for spacing said terminal supporting subassemblies from each other to locate the connecting situses thereon in spaced parallel planes each containing the connecting situses for connecting the leads from at least one of said electrical conductors.

12. A compound tandem rotary switch as defined in claim 7 and further characterized as including a shaft of electrically non-conductive material extending rotatably through each of said terminal plates, and each having one each of said first and second rotary wiper plates connected thereto for rotation therewith, and said shaft extending through one each of said first and second common conductor plates; and spring means around each of said shafts and continuously resiliently urging each of the wiper plates rotatable with the respective shaft into contact with one of the respective common conductor plates through which the shaft extends.

13. A compound tandem rotary switch as defined in claim 2 and further characterized as including a plurality of spaced cam studs on each of said anchor bands, and each positioned at the location where one of said insulating fins intersects one of said anchor bands.

14. A compound rotary switch as defined in claim 13 and further characterized as including, in association with each of said terminal supporting subassemblies:

a first common conductor integrally formed with one of said leads as a unitary structural element and extending from one of said tapped electrical conductors in one of the pairs thereof to one of said situses, and from said one situs to one of said wiper contacting positions; and a second common conductor integrally formed with another of said leads as a unitary structural element and extending from the other of said electrical conductors in said one pair to another of said situses, and from said other situs to another of said wiper contacting positions.

15. A compound tandem rotary switch as defined in claim 14 and further characterized as including means resiliently biasing each of said first and second common conductors into contact with different ones of said movable wiper means.

16. A compound rotary tandem switch as defined in claim 15 wherein each pair of movable wiper means comprises a pair of semicircular, spaced electrically conductive wiper rings; and wherein said means for electrically insulating said wiper means from each other comprises an electrically non-conductive wiper ring supporting plate having said wiper rings mounted thereon in substantially coplanar spaced relation.

17. A compound rotary tandem switch as defined in claim 16 wherein said means for concurrently moving the electrically conductive wiper means comprises a shaft extending through and keyed to said wiper ring supporting plate, and extending through said terminal ring.

18. A rotary switch comprising:

terminal supporting means for supporting a first plurality of terminals in semi-circular array in first terminal situses thereupon, and for supporting a second plurality of terminals in semi-circular array in second terminal situses thereupon complementary to said first plurality of terminals and on substantially equal radii thereto in relation to a common central axis;

a shaft extending rotatably through said terminal supporting means along said common central axis;

a first wiper element connected to said shaft for rotation therewith and including a portion projecting to a location of intersection with the arc of the semi-circular array of said first terminal situses for individual, consecutive contact with terminals in said first-mentioned semi-circular array as said shaft and first wiper element are rotated;

a second wiper element connected to said shaft for rotation therewith and spaced from said first wiper element, said second wiper element including a portion projecting to a location of intersection with the arc of the semi-circular array of said second terminal situses for individual consecutive contact with terminals in said second-mentioned semi-circular array as said shaft and second wiper element are rotated:

a first stationary common electrical conductor mounted on said terminal supporting means and extending from said first wiper element to one of said terminal situses in said second-mentioned semi-circular array; and a second stationary common electrical conductor mounted on said terminal supporting means and extending from said second wiper element to one of said terminal situses in said first-mentioned semicircular array.

19. A rotary switch as defined in claim 18 wherein said wiper elements are mounted on a common electrically non-conducting wiper ring supporting plate and are connected thereby to said shaft.

20. A rotary switch as defined in claim 18 wherein said terminal supporting means comprises:

an annular anchor band;

a central hub at the center of said annular anchor band and positioned around said shaft for free relative movement between said central hub and said shaft; and a plurality of insulating fins extending from the hub to the anchor band and defining with said anchor band, said first and second terminal situses.

21. A rotary switch as defined in claim 18 wherein said first and second wiper elements are, collectively, a pair of arcuate conductors mounted in a substantially common plane and electrically insulated from each other.

22. A rotary switch as defined in claim 19 wherein said terminal supporting means comprises:

an annular anchor band;

a central hub at the center of said annular anchor band and positioned around said shaft for free relative movement between said central hub and said annular anchor band; and a plurality of insulating fins extending from the hub to the anchor band and defining with said anchor band, said first and second terminal situses.

23. A rotary switch as defined in claim 19 wherein said first and second wiper elements are, collectively, a pair of arcuate conductors mounted in a substantially common plane and insulated from each other.

24. A rotary switch as defined in claim 23 wherein said terminal supporting means comprises:

an annular anchor band;

a central hub at the center of said annular anchor band and positioned around said shaft for free relative movement between said central hub and said shaft; and a plurality of insulating fins extending from the hub to the annular anchor band and defining with said anchor band, said first and second terminal situses.

25. A rotary switch as defined in claim 22 and further characterized as including means resiliently biasing said annular anchor band in an axial direction along said shaft and toward said wiper ring supporting plate whereby said first and second wiper elements are continuously retained in a position adjacent said terminal situses.

26. A rotary switch as defined in claim 24 and further characterized as including means resiliently biasing said annular anchor band in an axial direction along said shaft and toward said wiper ring supporting plate whereby said first and second wiper elements are continuously retained in a position adjacent said terminal situses.

27. A rotary switch comprising:

electrically non-conducting terminal supporting means defining a first plurality of discrete terminal situses, and a second plurality of discrete terminal situses spaced from said first plurality of terminal situses and disposed in substantially the same plane as said first plurality of terminal situses;

a shaft extending rotatably through said terminal supporting means;

a first electrically conductive wiper element connected to said shaft for rotation with said shaft about its axis and including a first portion projecting to a location in which said first portion is brought into juxtaposition to each of said first plurality of terminal situses when said shaft is rotated about its axis for individual, consecutive contact with terminals connected to said terminal supporting means at the several terminal situses in said first plurality of terminal situses;

a second electrically conductive wiper element connected to said shaft for rotation with said shaft about its axis and including a first portion projecting to a location in which said first portion of the second wiper element is brought into juxtaposition to each of said second plurality of terminal situses when said shaft is rotated about its axis for individual, consecutive contact with terminals connected to said terminal supporting means at the several terminal situses in said second plurality of terminal situses;

a first common electrical conductor on said terminal supporting means and extending from a point of contact with said first wiper element to one of said terminal situses in said second plurality of terminal situses; and a second common electrical conductor on said terminal supporting means and extending from a point of contact with said second wiper element to one of said terminal situses in said first plurality of terminal situses.

* * * * *